US005257069A

United States Patent [19]

Hirata et al.

[11] Patent Number: 5,257,069

[45] Date of Patent: Oct. 26, 1993

[54] COPYING MACHINE CONTROL SYSTEM CONTROLLING A PLURALITY OF COPYING MACHINES THROUGH COMMUNICATION NETWORK

[75] Inventors: Sumiaki Hirata, Aichi; Kazunobu Maekawa, Toyokawa; Kenzo Nagata, Okazaki, all of Japan

[73] Assignee: Minolta Camera Kabushiki Kaisha, Osaka, Japan

[21] Appl. No.: 971,302

[22] Filed: Nov. 4, 1992

[30] Foreign Application Priority Data

Nov. 6, 1991 [JP] Japan ..... 3-319855

[51] Int. Cl.[5] ..... G03G 15/00

[52] U.S. Cl. ..... 355/200; 355/206

[58] Field of Search ..... 355/200, 202, 204, 205, 355/206; 371/16.4; 395/113; 358/406

[56] References Cited

U.S. PATENT DOCUMENTS

| | | | |
|---|---|---|---|
| 3,997,873 | 12/1976 | Thornton | 340/825.31 |
| 4,162,396 | 7/1979 | Howard et al. | 371/16.4 |
| 4,167,322 | 9/1979 | Yano et al. | 364/140 |
| 4,339,657 | 7/1982 | Larson et al. | 355/206 X |
| 4,390,953 | 6/1983 | Johnstone | 364/474 |
| 4,497,037 | 1/1985 | Kato et al. | 355/202 |
| 4,583,834 | 4/1986 | Seko et al. | 355/206 |
| 4,766,548 | 8/1988 | Cedrone et al. | 364/479 |
| 4,797,706 | 1/1989 | Sugishima et al. | 358/300 |
| 4,881,104 | 11/1989 | Kusumoto et al. | 355/309 |
| 5,021,826 | 6/1991 | Maruta | 355/205 |
| 5,057,866 | 10/1991 | Hill, Jr. et al. | 355/200 |
| 5,077,582 | 12/1991 | Kravette et al. | 355/206 |
| 5,084,875 | 1/1992 | Weinberger et al. | 371/291 |
| 5,138,618 | 11/1992 | Honda et al. | 371/16.4 |
| 5,146,269 | 9/1992 | Shimizu et al. | 355/200 |

FOREIGN PATENT DOCUMENTS

| | | | |
|---|---|---|---|
| 59-142559 | 8/1984 | Japan . | |
| 63-80270 | 4/1988 | Japan | 355/203 |

OTHER PUBLICATIONS

Research Newsletter-Remote Diagnostics-Tool Kit of the Future, Dataquest, pp. 1-6, Feb., 1989.

*Primary Examiner*—Joan H. Pendegrass

*Attorney, Agent, or Firm*—Burns, Doane, Swecker & Mathis

[57] ABSTRACT

A method of controlling a plurality of copying machines through a communication network in accordance with the present invention receives data from a copying machine, detects the state of trouble occurrence as to a particular portion of the copying machine based on the data from the copying machine, determines whether or not the use of the particular portion should be prohibited based on the detected state of trouble occurrence, and transmits a prohibition signal instructing prohibition of the use of the particular portion to the copying machine, when it is determined that the use of the particular portion should be prohibited.

8 Claims, 25 Drawing Sheets

FIG. 4
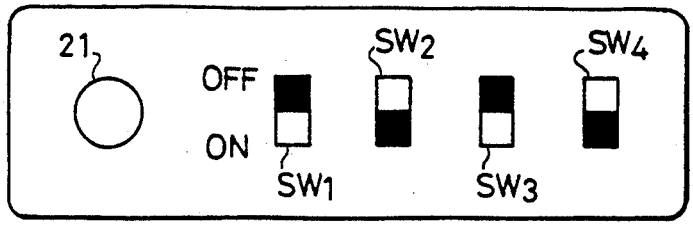
FIG. 5
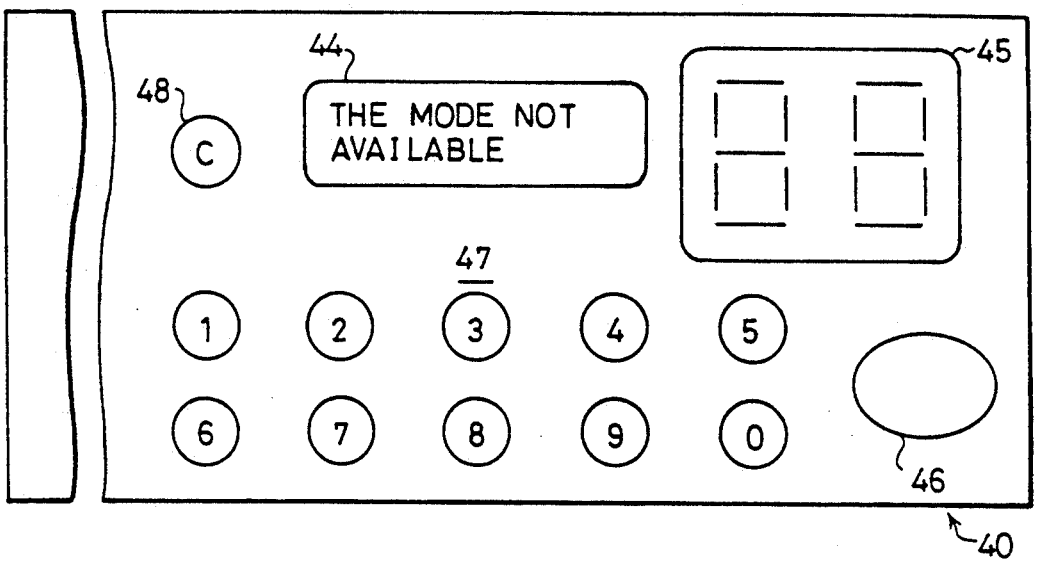
FIG. 6
| | | | | | | | |
|---|---|---|---|---|---|---|---|
| $b_7$ | $b_6$ | $b_5$ | $b_4$ | $b_3$ | $b_2$ | $b_1$ | $b_0$ |
DISCHARGE CODE: DISCHARGE OF ONE SHEET OF PAPER = FALLING OF $b_0$
JAM CODE: $b_7 = 1$, $b_6 = 0$
TROUBLE CODE: $b_7 = 1$, $b_6 = 1$

FIG. 25

| DTID | USER | MODEL NAME | SERIAL NO. | DATE AND TIME OF TRANSMISSION | USE PROHIBITION FLAG | USE PROHIBITION BLOCK | |
|---|---|---|---|---|---|---|---|
| 0001 | AAA | A1 | 0000001 | 9010101700 | 1 | A, B | |
| 0002 | BBB | B1 | 0000001 | 9010101705 | 1 | C | |
| 0003 | CCC | C1 | 0000002 | 9010101710 | 0 | 0 | |
| | | | | | | | |
| | | | | | | | |

FIG.26

USE PROHIBITION BLOCK CODE

| USE PROHIBITION BLOCK | CODE |
|---|---|
| DUPLEX ORIGINAL MODE | 0 1 |
| ORIGINAL-MOVING COPY MODE | 0 2 |
| DUPLEX COPY MODE | 0 3 |
| STAPLE MODE | 0 4 |
| SORT MODE | 0 5 |
| TOP STAGE CASSETTE | 0 6 |
| MIDDLE STAGE CASSETE | 0 7 |
| BOTTOM STAGE CASSET | 0 8 |
| . . . . . | . . |
| . . . . . | . . |
| USE OF MACHINE PROHIBITED | 9 9 |

COPYING MACHINE CONTROL SYSTEM CONTROLLING A PLURALITY OF COPYING MACHINES THROUGH COMMUNICATION NETWORK

BACKGROUND OF THE INVENTION

1. Field of the Invention

The present invention relates generally to copying machine control systems, and more specifically, to a method of controlling copying machines by transmitting data related to a corresponding copying machine from a copying machine control unit each connected to the copying machines to a centralized control unit in a control center through a communication line.

2. Description of the Related Art

A system of controlling a plurality of copying machines is disclosed in U.S. Pat. No. 4,583,834. In this disclosed system, various kinds of information on a copying machine such as the total number of copy sheets, troubles, and the remaining amounts of copy sheets and toner are transmitted to a computer. The computer processes the transmitted information and feeds back instructions to the copying machine. In such a system, a plurality of copying machines supplied to users can be connected to a centralized control unit through a communication network such as a telephone line for remote control of the copying machines. The centralized control unit is provided at the controlling party, and the controlling party receives information transmitted from the copying machines utilizing the centralized control unit. Control works such as issue of bills corresponding to the numbers of copy sheets, and dispatch of servicemen to cope with troubles are conducted.

Since a general copying machine does not have a function of communicating with a centralized control unit through a communication network, a data terminal for communication is provided to a copying machine when the system is constructed. The data terminal collects a various kinds of information from the copying machine and communicates with the centralized control unit based on the collected information.

In a certain type copying machine, a particular operation mode or the use of a particular portion may be desirably prohibited, when that particular operation mode or the frequency of trouble occurrence at the particular portion becomes significantly large. A determination of such prohibition may be made based on information from a single copying machine, but it is desirable to make such a decision based on information from a plurality of copying machines of the same type.

SUMMARY OF THE INVENTION

It is an object of the invention to provide a copying machine control system allowing overall control of a plurality of copying machines.

Another object of the invention is to provide a copying machine control system allowing prohibition of a particular operation mode or use of a particular portion in a copying machine from a control center depending upon the situations of the copying machine.

In order to achieve the above-stated objects, a method of controlling a plurality of copying machines through a communication network in accordance with the invention includes receiving data from a copying machine, detecting the situation of trouble occurrence with respect to a particular portion of the copying machine based on data from the copying machine, determining whether or not use of the particular portion should be prohibited based on the detected situation of trouble occurrence, and transmitting a prohibition signal instructing prohibition of the use of the particular portion to the copying machine, when it is determined that the use of the particular portion should be prohibited.

The method of controlling the copying machines as stated above allows accurate control and effective use of the copying machines, because the use of the particular portion is controlled depending upon the situation of trouble occurrence.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4 is a view for use in illustration of operation switches at a data terminal in the system shown in FIG. 1;

FIG. 5 is a view for use in illustration of a part of the operation panel of a copying machine in the system shown in FIG. 1;

FIG. 6 is a representation for use in illustration of codes transmitted to a corresponding data terminal from a copying machine in the system shown in FIG. 1;

FIG. 25 is a representation for use in illustration of the contents of data registered for every user;

FIG. 26 is a representation for use in illustration of use prohibition block codes in accordance with one embodiment of the invention.

DESCRIPTION OF THE PREFERRED EMBODIMENTS

Now, embodiments of the present invention will be described.

[1]Structure of System

The structure of the system formed of "copying machine·data terminal (DT)·communication network·center" will be described.

Figure 1:
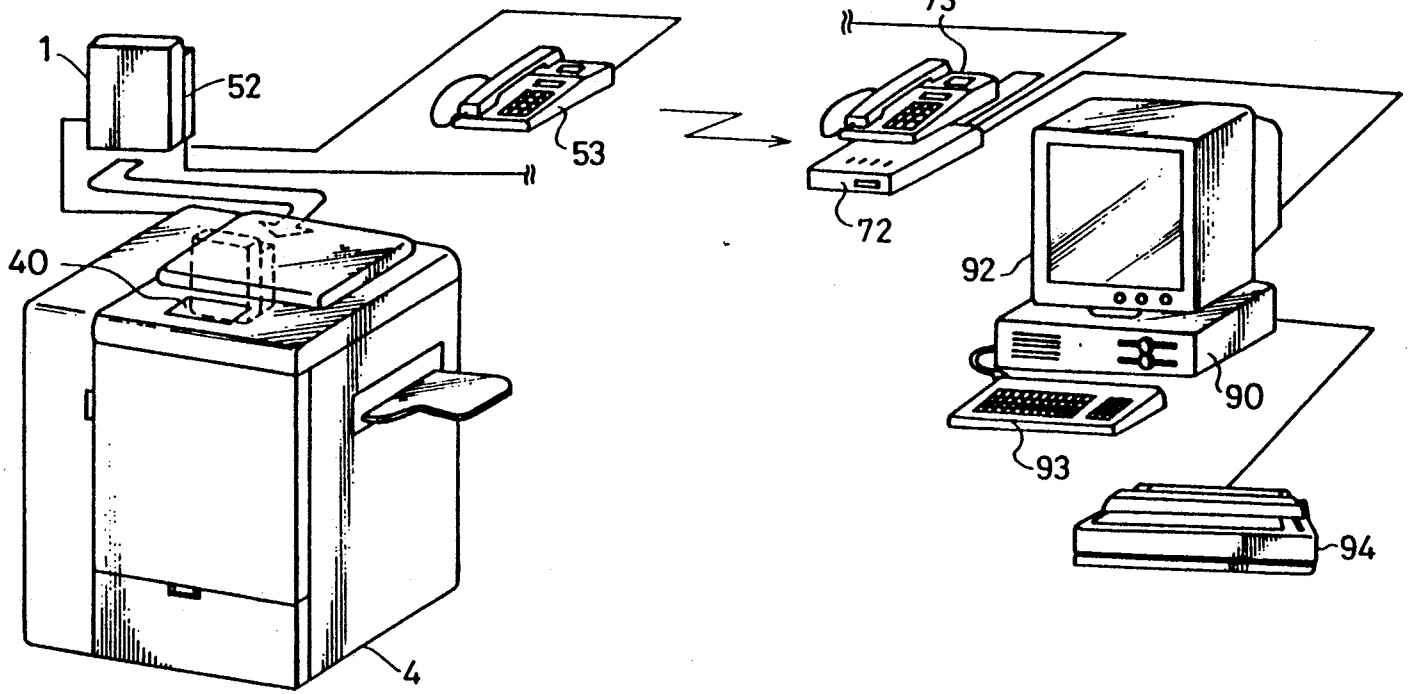
FIG. 1 is a view schematically showing the structure of a copying machine control system in accordance with one embodiment of the invention.
Figure 2:
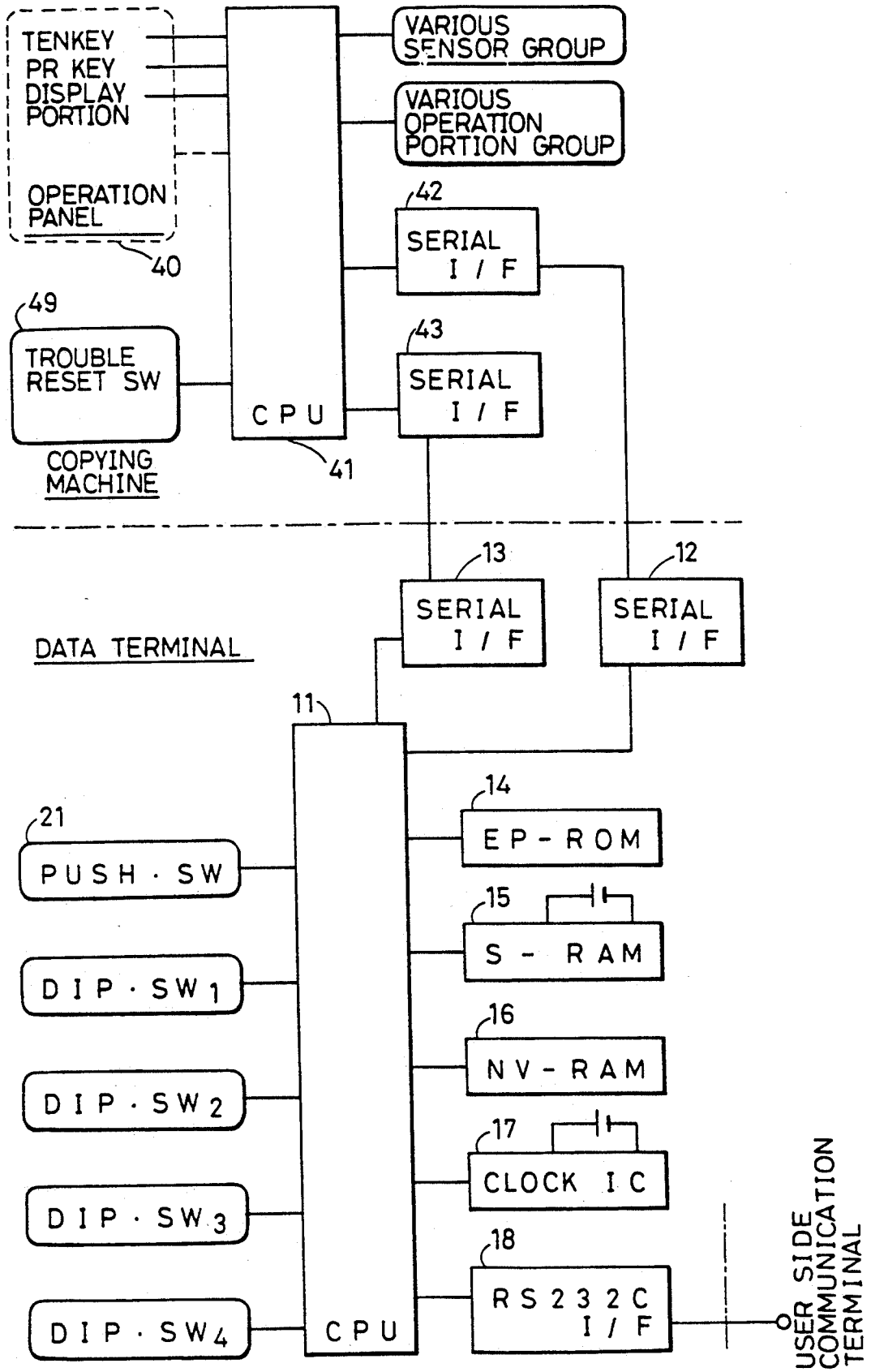
FIG. 2 is a part of a block diagram showing the circuit configuration of the system shown in FIG. 1.
Figure 3:
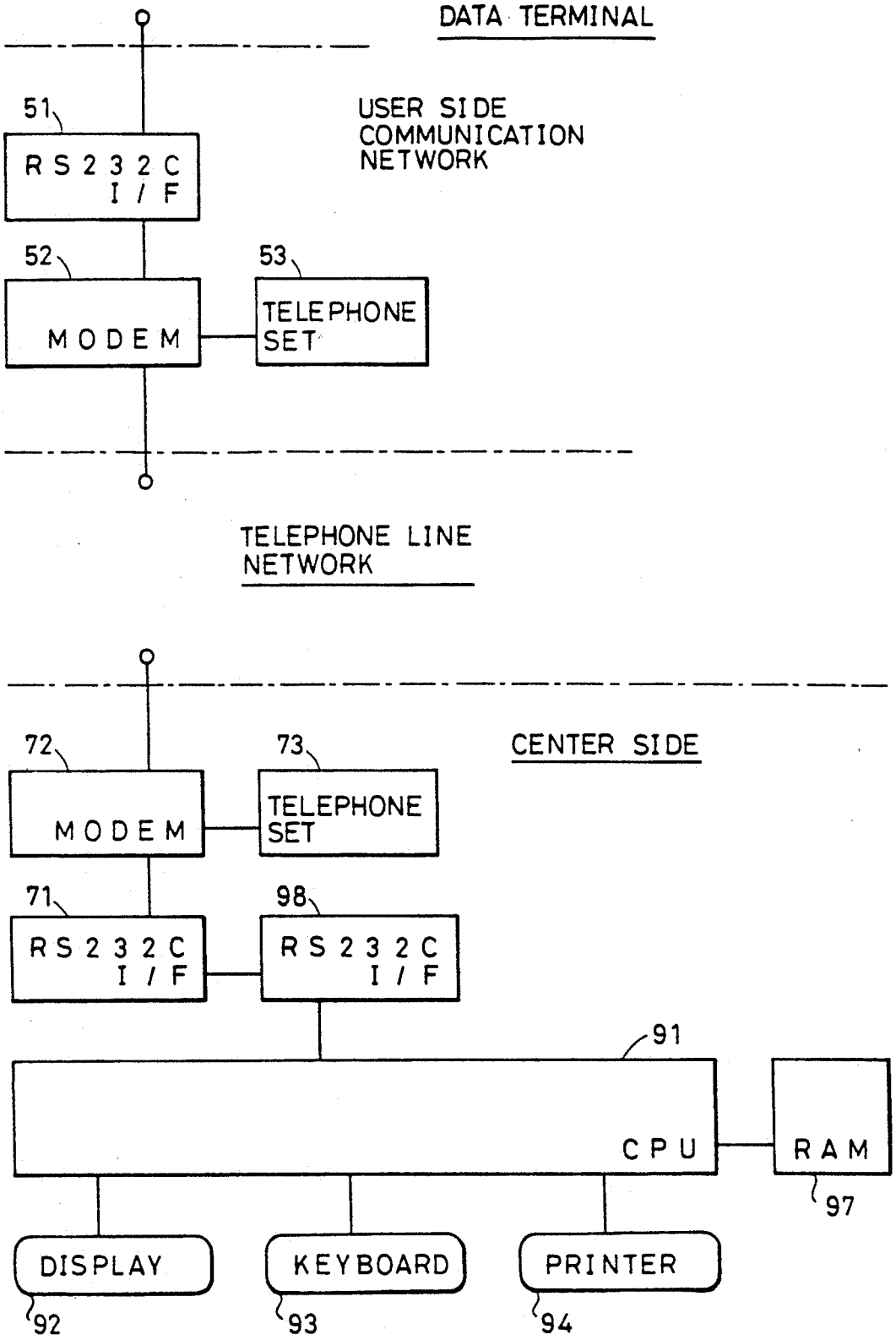
FIG. 3 is the remaining part of the block diagram showing the circuit configuration of the system shown in FIG. 1.

FIG. 1 illustrates the structure of the present system, and FIGS. 2 and 3 are block diagrams each showing the circuit configuration of the present system. The present system is formed of a user side apparatus (among a plurality of users, one user apparatus is described by way of illustration), an apparatus at the center side which is a controlling party, and a communication network for connecting them.

Provided at the user side are a copying machine 4, a data terminal 1, a modem 52 which functions as a communication terminal apparatus, a telephone set 53 which is a usual communication apparatus.

Provided at the center side are a modem 72 which functions as a communication terminal apparatus, a telephone set 73 which is a usual communication apparatus, and a computer 90. A CPU 91 installed in the computer 90, and a display 92, a keyboard 93, and a printer 94 are connected to the computer.

The data terminal 1 accepts various kinds of information on the copying machine 4, conducts prescribed processings, and transmits the processed data to the computer 90 on the center side.

At the center, various processings with respect to a copying machine of interest are conducted based on the transmitted incoming data. For example, based on the collected data, whether or not the use of each portion in the copying machine should be continued is determined. If the continuing use is not appropriate, the use of the portion in question or the use of the entire copying machine is prohibited by the center side.

Now, description will be provided on respective apparatuses.

Copying Machine 4

The copying machine 4 scans an original image and forms a copy image on sheet paper.

In the copying machine 4, various kinds of element data which has effects on image formation process (such as time required for feeding sheets of paper, the potential of the surface of a photoreceptor drum, a toner concentration in a developer an exposure amount of the photoreceptor drum, developing bias voltage, the amount of toner sticking onto the photoreceptor drum, and the grid voltage of a corona charger) is detected by various sensor groups disposed in positions in the copying machine 4, accepted by the CPU 41 for processing, and then transmitted to the CPU 11 of the data terminal 1 through a serial I/F 43 and serial I/F 13. The above-stated various kinds of element data are represented in an abstract manner as element data $x_i$ (i = the number of element data items equal to or larger than 1) in the following description of flow charts.

In the CPU 41 of the copying machine 4, values in counters used as criteria for charge amounts calculated at the center side (a total counter showing the number of sheets discharged, a counter for separate sheet sizes showing the numbers of sheets used for separate sizes), counters used as criteria for maintenance (a JAM counter for separate portions showing the number of JAMs for every portion, a trouble counter for separate portions showing the number of troubles for every portion, a PM counter for separate parts showing the number of use for every parts) are calculated and transmitted to the CPU 11 of the data terminal 1 through a serial I/F 42 and serial I/F 12. It is noted that the PM counter is for calculating the number of the use for every parts, whose count value is used, for example, as a criterion for parts exchange.

In the CPU 41 of the copying machine 4, signals from various key switch groups disposed on the operation panel 40 (see FIG. 5) (a print key 46 for instructing initiation of a copying operation, a ten key group 47 for inputting values, or the like) or from various switch groups disposed on other than the operation panel (a trouble reset switch 49 for instructing reset upon trouble or the like) are input, and setting of a corresponding operation/mode is executed based on the input signal.

When a use prohibition block code is transmitted from the side of the data terminal 1 through the serial I/F 12 and serial I/F 42, setting of a mode corresponding to the code (see FIG. 26) is prohibited, or selection of an option corresponding to the code (see FIG. 26) is prohibited.

Data Terminal 1

The data terminal 1 accepts the data of the copying machine 4, activates the modem 52 to connect a communication line with the center side when prescribed transmission conditions (wherein a transmission flag is set to "1" which will be later described in detail) are satisfied, and transmits data for controlling the copy machine (the above-stated element data, count data, etc.) to the CPU 91 in the center.

An ROM 14 in which control programs are stored, a non-volatile memory 16 for storing numeral data, etc., a system RAM 15 for battery-backup operations, a battery-backed up clock IC 17 and the like are connected to the control CPU 11 of the data terminal 1.

The CPU 11 accepts incoming data transmitted from the CPU 41 of the copying machine 4 through the serial I/F 12 or the serial I/F 13 and executes a prescribed processing. data of 8 bits $b_7-b_0$ input into the data terminal 1 from the serial I/F 12 is arranged as shown in FIG. 6.

More specifically, a paper discharge code indicating discharge of paper is represented by the rising edge of the bit $b_0$ (change from 1 to 0), a JAM code indicating the occurrence of a paper jam is represented by bit $b_7=1$ and bit $b_6=0$. A trouble code indicating the occurrence of various troubles is represented by bit $b_7=1$ and bit $b_6=1$. The 8 bit data is input to the data terminal 1 both periodically and when a paper jam or trouble occurs in the copying machine 4.

The CPU 11 sets a prescribed operation/mode, in response to an operation input each from various operation switches shown in FIG. 4 (a push switch 21, and four dip switches DIP·SW1–DIP·SW4).

The dip switch DIP·SW4 is a switch for setting an initialization mode. The dip switch DIP·SW1 is for setting an input mode for the select number (telephone number) of the center, the dip switch DIP·SW2 is for setting an input mode for an ID number (DTID) for identifying the data terminal 1, and the dip switch DIP·SW3 is for setting an input mode for an ID number for identifying the center (the center ID). The push switch 21 is for instructing and initialization transmission.

The CPU 11 is also connected to the communication I/F (RS232CI/F) 51 of the modem 52 through a communication I/F RS232CI/F) 18. More specifically, the CPU 11 is constructed such that through these equipments it can give the modem 52 an instruction of calling the modem 72 on the center side. In other words, the CPU 11 is arranged so that it can communicate with the CPU 91 on the center side by connecting a communication line to the modem 72 on the center side.

The contents of data transmitted from the CPU 11 to the CPU 91 on the center side through the communication line (data for controlling the copying machine 4) is, as will be later described, determined by the kind of a transmission flag set to "1".

It is to be noted that when a use prohibition block code (see FIG. 26) is transmitted from the center side, a corresponding code is, as will be described later, transmitted to the CPU 41 of the copying machine 4 through the serial I/F 12.

Center

The CPU 91 is a computer apparatus formed in connection with the communication terminal apparatus (modem) 72 so that it can be connected to the data terminal 1 of each of a number of users through a communication network. A copying machine 4 corresponding to the data terminal 1 of each of the number of users is controlled by the CPU 91 of the center.

Various kinds of data (element data, count data or the like) are transmitted to the CPU 91 from each data terminal 1 through the communication network, modem 72, and the communication I/F (RS232CI/F) 71 on the side of modem 72 and the communication I/F (RS232CI/F) 98 on the side of CPU91. The data is processed at the CPU 91. Consequently, depending upon the necessity, a use prohibition block code, threshold value data for count data, etc are transmitted to the data terminal 1.

At the end of the month, charge amounts are calculated based on received data and bills are printed out.

[2] Control for System

Now, control for the present system will be described in the order of processings, i.e. a processing in the CPU 41, a processing in the CPU 11, and a processing in the CPU 91.

Prior to a further description, the terms "on edge" and "off edge" herein will be defined. When switches, sensors, signals, etc. change their states from an off state to an on state, the transition of the state is defined as "on edge". On the other hand, when the switches, the sensors, the signals, etc. change their states from an on state to an off state, such state transition is defined as "off edge".

Processing in Copying Machine 4

Figure 7:
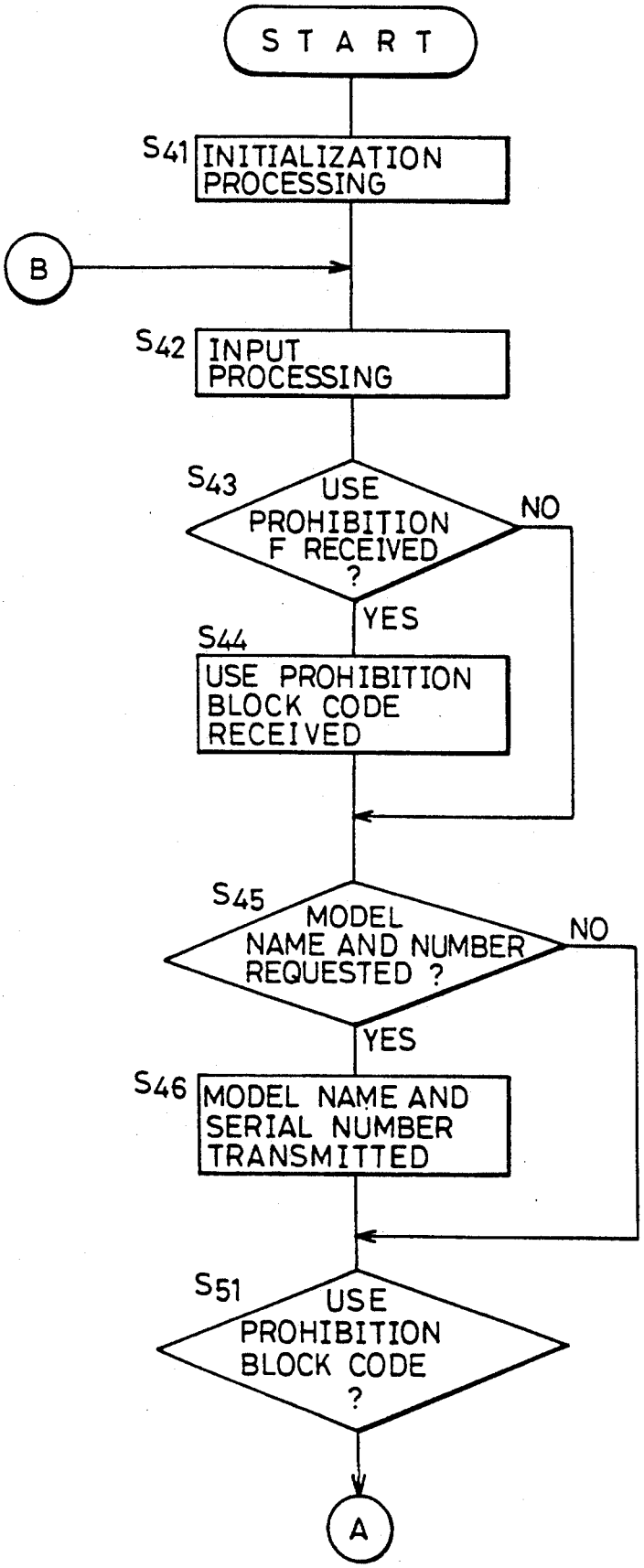
FIG. 7 is a flow chart showing a part of the main routine of the processing of a CPU in a copying machine in the system shown in FIG. 1.

A processing executed in the CPU 41 in the copying machine 4 will be described in conjunction with the flow charts in FIGS. 7 and 8.

In the CPU 41, the processing is for example started by turning on a power supply, and then initialization such as clearing of memories and setting of a standard mode is executed (S41). Then, a loop processing including steps S42–S65 will be repeatedly executed.

Step S42 is a step of indicating en bloc a processing of accepting various input signals. The input signals include, for example, input signals from the group of key switches on the operation panel 40 or a use prohibition block code, etc. transmitted from the data terminal 1.

In the above-stated step S42, when a use prohibition flag from the data terminal 1 is received (S43;YES), a reception processing for the use prohibition block code transmitted from the data terminal 1 is conducted (S44).

In step S42, if the name of the model and the serial number are requested by the data terminal 1 (S45:YES), the name of the model and the serial number are transmitted to the data terminal 1 (S46).

In step S51, the use prohibition block code received in step S44 is determined. If the result indicates "code=01", setting of duplex original mode is prohibited (S52, see FIG. 26). If the result indicates "code=02", setting of original-moving copy mode is prohibited (S53). As for the other codes, setting of a corresponding mode, or selection of an operation is similarly prohibited (S54–S59).

It is noted that if any use prohibition block code is not received in step S44, prohibition of a mode or an operation will not be conducted.

In step 61, determination whether or not a mode or an operation instructed from the operation panel 40 of the copying machine corresponds to any of the modes or operations prohibited in steps S52–S59 is made. If the result indicates that it is a prohibited mode or operation (S61;YES), the prohibition of the mode or operation will be displayed, at "44" in FIG. 5 (S62).

If the mode or operation instructed from the operation panel 40 is a mode or operation which is not prohibited (S61;NO), processings after step 63 will be executed.

More specifically, if a copying operation is going on (S63;YES), various processings necessary for the copying operation will be sequentially executed (S64). It is noted that step S64 is a step for indicating en bloc processings necessary for a copying operation or the like which includes control of a group of various operation portions such as paper feeding control, scan control, photoreceptor drum control, developer control and the like.

If a JAM or any other trouble takes place (S65;YES), a signal in response to such a trouble is transmitted to the CPU 11 (S66). Thereafter, when a trouble reset switch 49 is operated by, for example, an operator (S67;YES), a trouble reset signal is transmitted to the CPU 11. In the CPU 11, a processing which will be described later is executed in response to a paper discharge code after cancellation of the trouble signal or the trouble.

Processing in Data Terminal 1

A processing in the CPU 11 in the data terminal 1 will be described in conjunction with the flow charts in FIGS. 9–20.

(a) Main Routine

Figure 9:
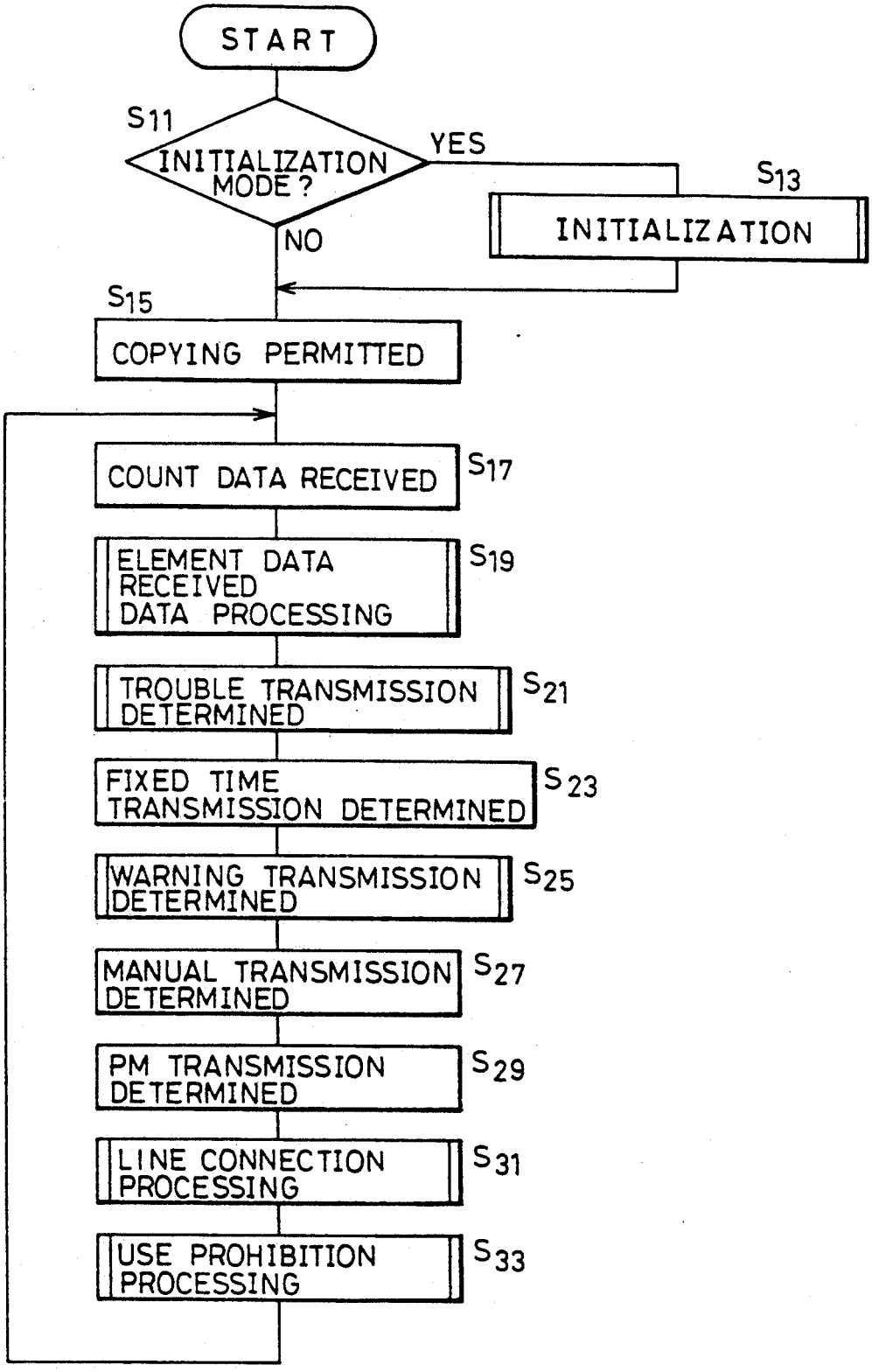
FIG. 9 is a flow chart showing the main routine of the processing of a CPU at a data terminal in the system shown in FIG. 1.

The processing will schematically be described by way of the main routine shown in FIG. 9.

In the CPU 11, the processing is initiated by, for example, turning on a power supply. When an initialization mode is set (S11;YES), an initialization processing (S13) is executed, and then a copy permission signal is transmitted to the CPU 41 of the copying machine (S15). Meanwhile, if the initialization mode is not set (S11;NO), a copy permission signal is immediately transmitted (S15), thus repeating a loop processing of steps S17–S33.

The following processing is executed in each subroutine.

* Initialization: S13

When the processing is initiated, if the DIP·SW4 is on, in other words, the initialization mode is set (S11;YES), the initialization is executed. The select number (telephone number) of the center, the ID number (DTID) of a data terminal, and the ID number (center ID) of the center are set, and an initialization setting transmission is conducted. These operations will be later described in further detail.

* Count Data Reception: S17

A reception processing for various count data transmitted from the CPU 41 is conducted. The contents of data includes a discharge code, a JAM·trouble code, a JAM·trouble count value, a separate paper size count value, and a PM count value. In the CPU 11, these kinds of data are updated to the latest values and held therein.

* Element Data Reception.Data Processing: S19

As will be described later, mean values for the element data and data corresponding to standard deviation are operated and updated to the newest values.

* Trouble Transmission Determination: S21

As will be described later, a determination is made whether or not trouble data and trouble recovery data should be transmitted to the center side.

* Fixed Time Transmission Determination: S23

At a prescribed fixed transmission time, a fixed time transmission flag is set to 1. Thus, various count data and various element data are transmitted to the center.

After the transmission is completed, data on the next fixed transmission time, present time data, and due date data for bills are transmitted from the center.

* Warning Transmission Determination: S25

Also will be described later, the element data, the count value of the JAM counter, and the count value of the PM counter are compared to their respective threshold values.

Based on the result of the comparison, it is determined whether or not warning data and warning recovery data should be transmitted to the center.

* Manual Transmission Determination: S27

If the initialization mode is not set and the push switch 21 is turned on, a manual transmission flag is set to 1. Thus, various element data is transmitted to the center.

* PM Transmission Determination: S29

A count value before clearing of the PM counter which has had its count value cleared to be "0" by exchange of parts is transmitted to the center.

* Line Connection Processing: S31

As will be described later, when any of the transmission flags is set to "1", the modem 52 is activated and a connection processing between the center side and the communication line is executed. Furthermore, after the connection to the communication line, a data communication with the CPU 91 at the center side is executed. It is noted that at the time of the data communication if a use prohibition block code is transmitted from the center side, a use prohibition flag is set.

* Use Prohibition Processing: S33

The use prohibition processing is a processing executed when the use prohibition flag is set to 1 in the course of line connection processing. The processing will be later described in further detail.

(b) Subroutines

Now, the subroutines will be described in detail in conjunction with FIGS. 10–20.

Figure 10:
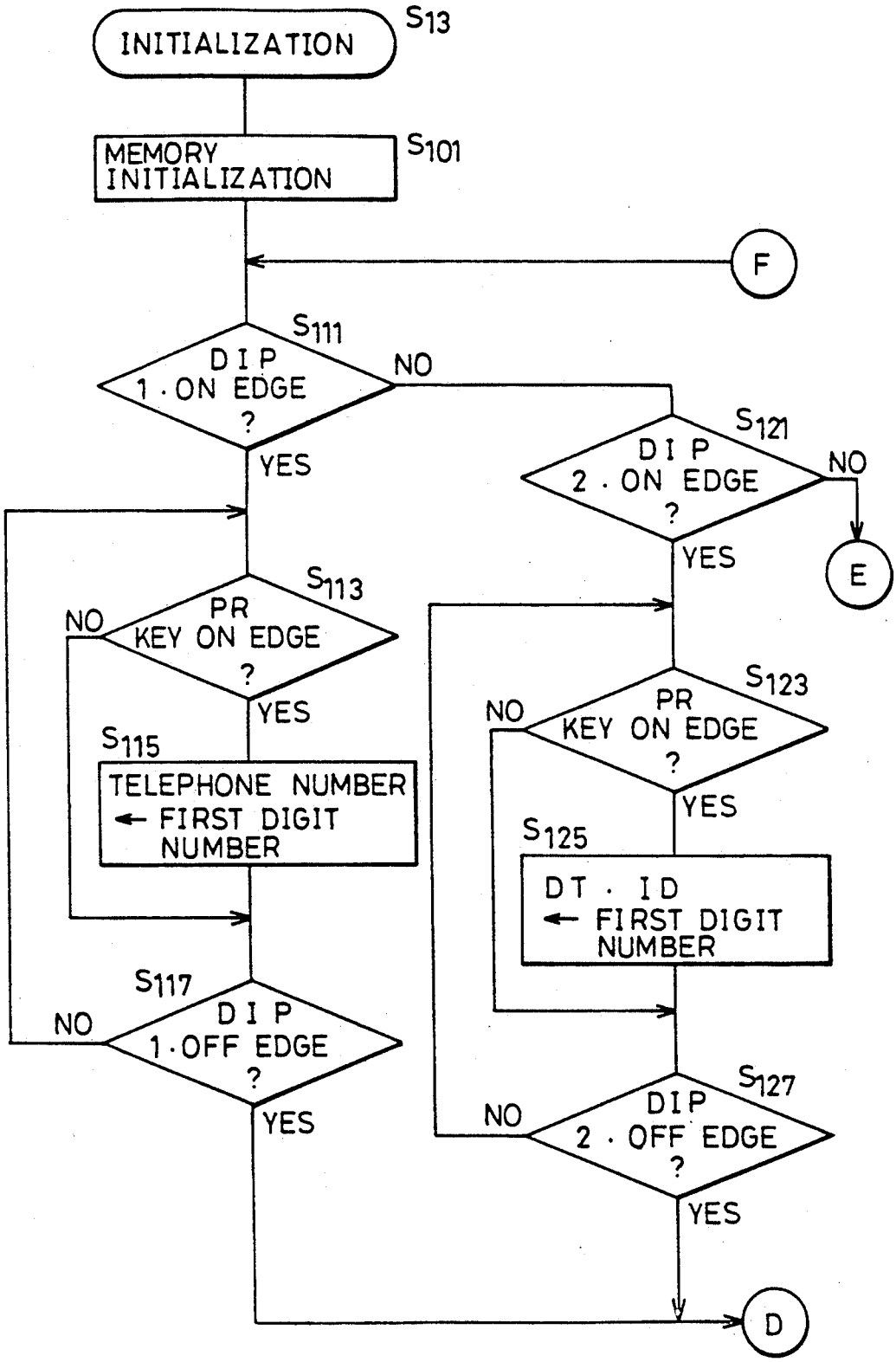
FIG. 10 is a flow chart showing a part of the specific content of the initialization processing routine in FIG. 9.
Figure 11:
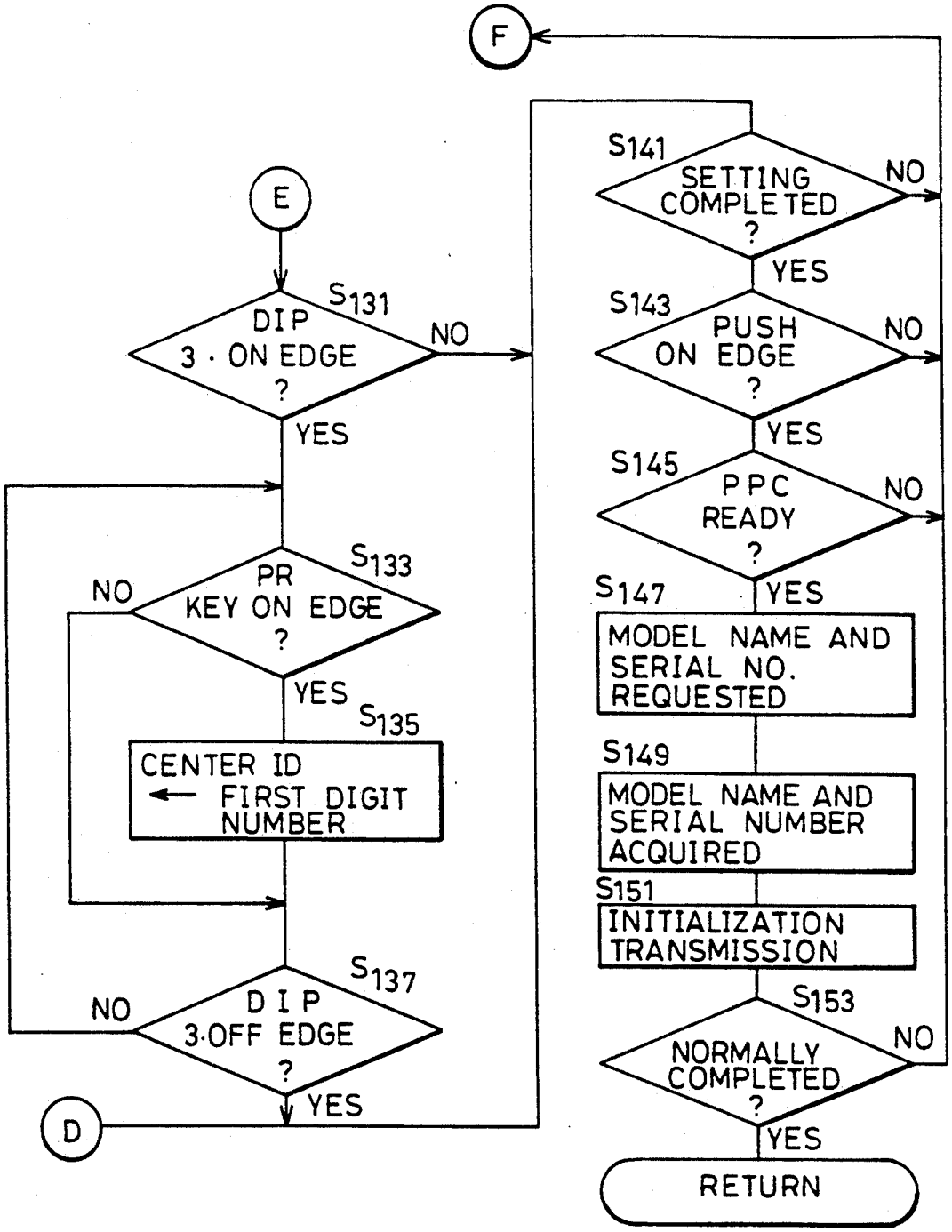
FIG. 11 is a flow chart showing the remaining part of the specific content of the initialization processing routine in FIG. 9.

* Initialization Processing (FIG. 10, FIG. 11)

The present processing is executed when the power supply is turned on and the dip switch DIP·SW4 is on (S11;YES). In this processing, an acceptance processing for initialization of the select number of the center, the ID number of the data terminal (DTID), and the ID number of the center (center ID), and input of the identification data of the connected copying machine (model name·serial number) and an initialization transmission are conducted.

A memory 15 is initialized (S101), and then a waiting state for turning on the dip switches DIP·SW-1–DIP·SW3 is provided.

When the dip switch DIP·SW1 is on (S111;YES), an input mode for the select number (telephone number) of the communication terminal apparatus of the center is set. More specifically, a value input by the use of the ten keys 47 of the copying machine and displayed in the first digit of the display portion 45 is stored in the non-volatile memory 16 as the select number data of the center in response to the input of the print key 46 (S113;YES). The select number input mode is canceled by turning off the dip switch DIP·SW1 (S117).

Similarly, an input mode for DTID is set in response to the on state of the dip switch DIP·SW2, and a value displayed in the first digit of the display portion 45 is stored in the non-volatile memory 16 as the DTID data (S125) in response to the input of print key 46 (S123;YES). The DTID input mode is canceled by turning off the dip switch DIP·SW2 (S127).

Similarly, in response to the on state of the dip switch DIP·SW3, an input mode for the center ID is set, and a value displayed in the first digit of the display portion 45 is stored in the non-volatile memory 16 as the center ID data (S135) for every input of the print key 46 (S133;YES) The center ID input mode is canceled by turning off the dip switch DIP·SW3 (S173).

Thus, when the setting of the three kinds of data is completed (S141;YES), the push switch 21 is available. More specifically, when the push switch 21 is pressed (S143;YES), the identification data of the copying machine is requested (S147), provided that the side of the copying machine connected thereto is ready (S145;YES) When the identification data is transmitted from the copying machine side, after the data is accepted through the serial I/F 12 (S149), an initialization transmission to the control center is conducted (S151).

In other words, the center is called through the communication network, and the above-stated two kinds of ID data and the identification data are transmitted to the CPU 91 at the center (see FIG. 25). It is noted that when the transmission is completed, data (the due date of the count data, the next fixed transmission time, the present time, and a threshold value for warning determination) transmitted from the CPU 91 of the control center is received.

When the transmission and reception are completed in this way, it is determined whether or not the communication is normally conducted (S153). If the result of the determination indicates that the communication was not conducted normally (S153;NO), the process returns to step S111, producing a waiting state for once again turning on the push switch 21. If the result indicates that the communication was conducted normally (S153;YES), the process returns to the main routine. Thus, the processing after step S15 is executed.

Figure 12:
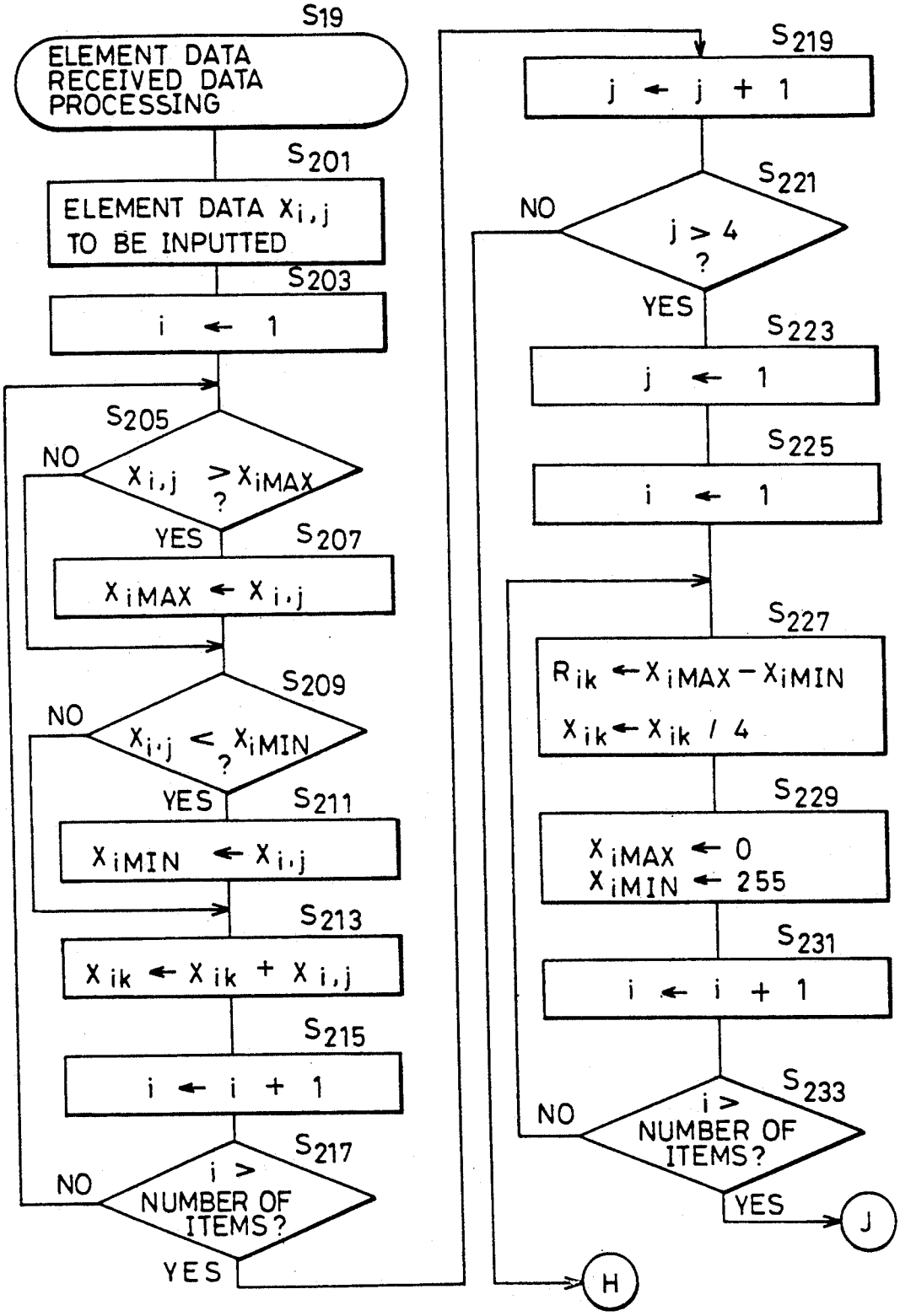
FIG. 12 is a flow chart showing a part of the specific content of the element data reception/data processing routine in FIG. 9.
Figure 13:
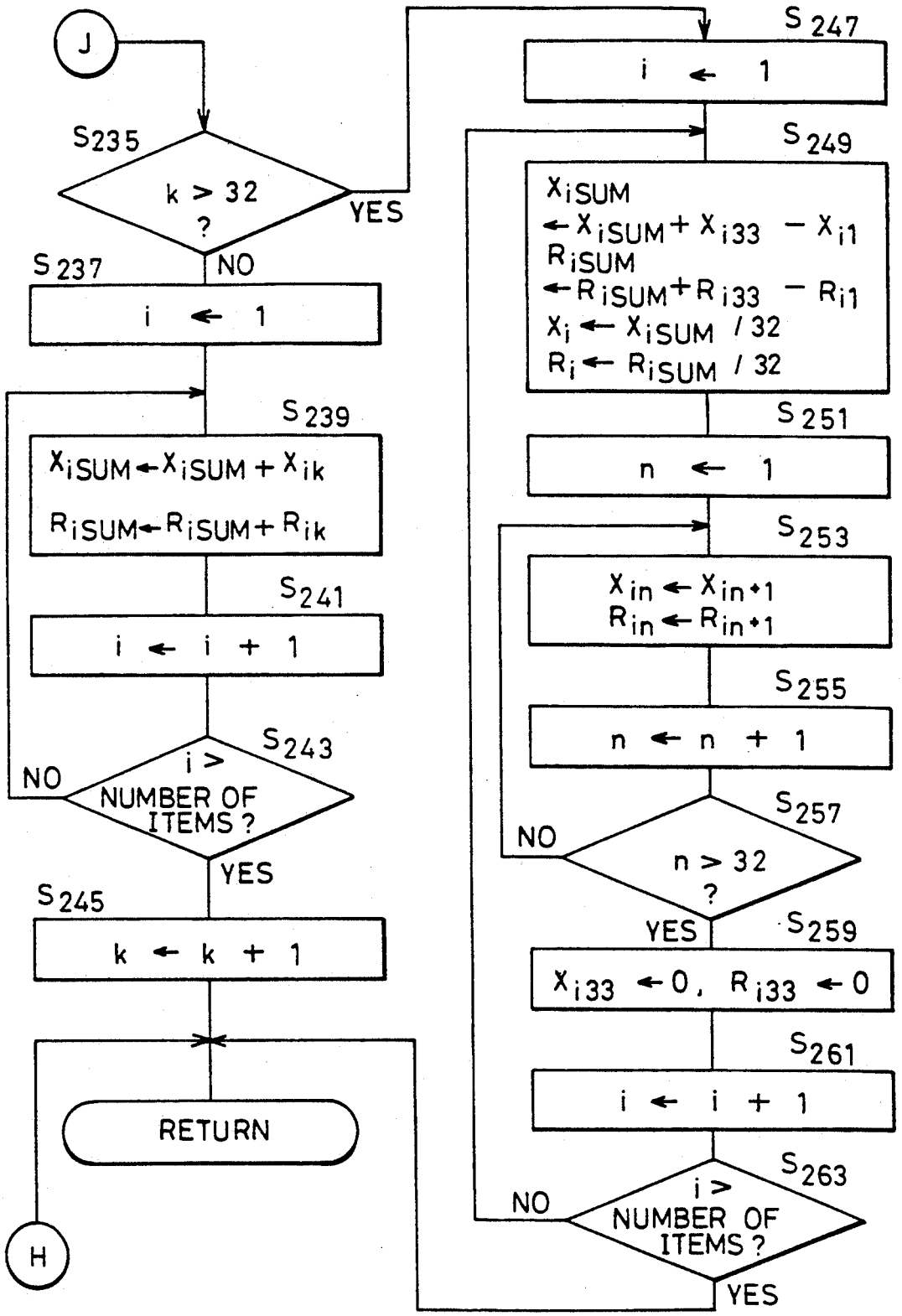
FIG. 13 is a flow chart showing the remaining part of the specific content of the element data reception/data processing routine in FIG. 9.

* Element Data Reception, etc. (FIG. 12, FIG. 13)

In the present subroutine, data for comparison with a threshold value (warning transmission determination; see FIG. 15) is operated based on the element data transmitted from the copying machine.

An element data group $x_{i,j}$ transmitted from the copying machine for every discharge of a copy paper sheet is accepted from the serial I/F 13 (S201). The subscript i represents an item number in the element data, and the subscript j represents the order in the items.

After an initialization value 1 is substituted for the item number i (S203), a maximum value $x_{iMAX}$, a minimum value $x_{iMIN}$, and a sum $x_{iK}$ are sequentially updated for every item (S205–S217). Thereafter, the subscript j is incremented (S219), thus returning to the main routine.

Thus, when the processing including steps S201–S217 is executed four times for every item (S221;YES), after the subscript j is reset to 1 (S223), the initialization value 1 is substituted for the item number i (S225), the difference $R_{iK}$ between the maximum value and the minimum value and the mean value $x_{iK}$ for the four pieces of data are operated for every item (S227–S233). It is noted that step S229 provides initialization values for the maximum value $x_{iMAX}$ and the minimum value $x_{iMIN}$ in preparation for a processing in the next steps S205–S211.

After the processing in steps S227–S233, processings of steps S237–S245 or steps S247–S263 is executed.

The processing of steps S237–S245 is conducted when the total number of the processings of steps S227–S233 has not reached 33 times. More specifically, the sum $R_{iSUM}$ of the difference $R_{iK}$ between the maximum value and the minimum value, and the sum $X_{isum}$ of the mean value $X_{iK}$ of the four pieces of data are operated 32 times for every item.

The processing of steps S247–S263 is conducted when the processing of steps S227–S233 is conducted totally more than 33 times. In other words, the sum $R_{iSUM}$ of the difference $R_{iK}$ between the maximum value and the minimum value, the sum $X_{iSUM}$ of the mean value $X_{iK}$ of the four pieces of data are operated for the data of the latest 32 times and the mean values $X_i$ and $R_i$ for each pieces of data are operated.

Thus, the mean value $X_i$ for the data of the latest 128 ($=4\times32$) pieces and the mean value of deviation $R_i$ (value corresponding to standard deviation) are provided for every item of the element data.

Figure 14:
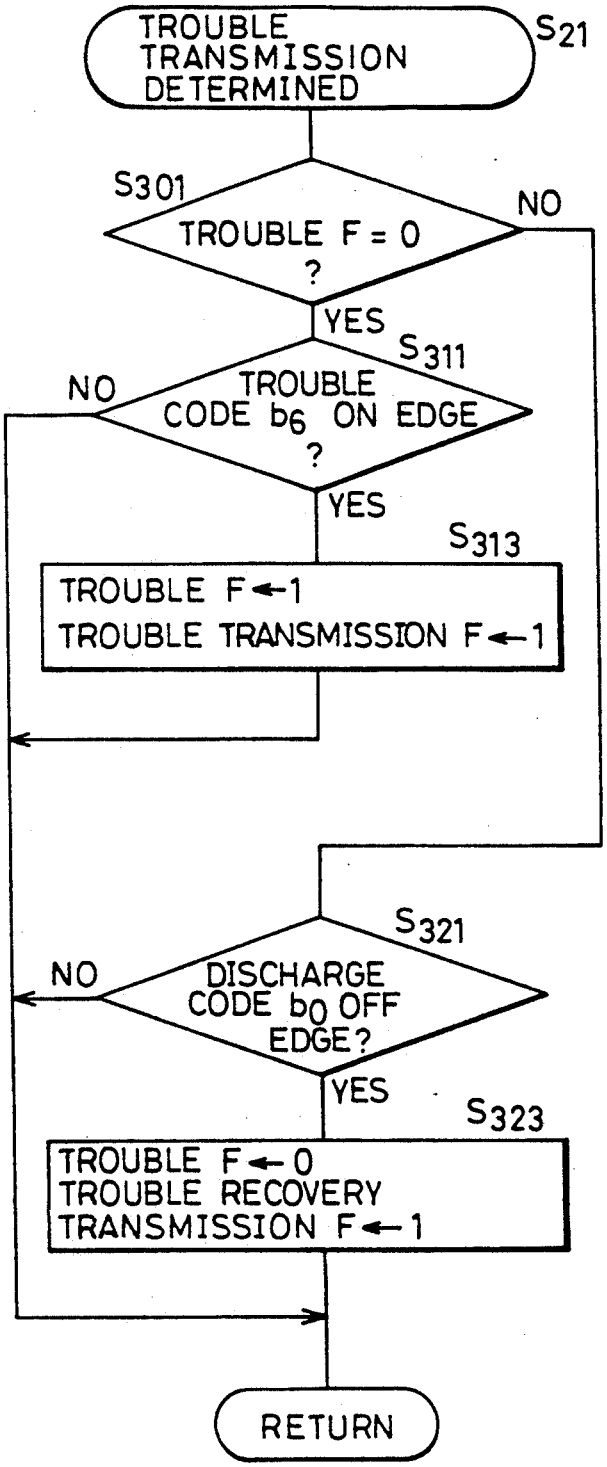
FIG. 14 is a flow chart showing the specific content of a trouble occurrence determination processing routine in FIG. 9.

* Trouble Transmission Determination (FIG. 14)

In this processing, a trouble transmission and a trouble recovery transmission are controlled.

For example, if a trouble code from the copying machine is detected (S311;YES) in the state of "trouble flag=0" (S301;YES), the trouble flag and the trouble transmission flag are both set to "1" (S13).

Also in the state of "trouble flag=1" (S301; NO), if a paper discharge code from the copying machine is detected (321; YES), the trouble flag is reset to "0", and the trouble recovery transmission flag is set to "1" (S323). This is because discharge of a paper sheet in the copying machine shows that the trouble has been recovered.

When the trouble transmission flag or the trouble recovery transmission flag is thus set to "1", the line connection processing (FIGS. 17–19) is executed, and the trouble data or the trouble recovery data is transmitted to the CPU 91 in the center.

Figure 15:
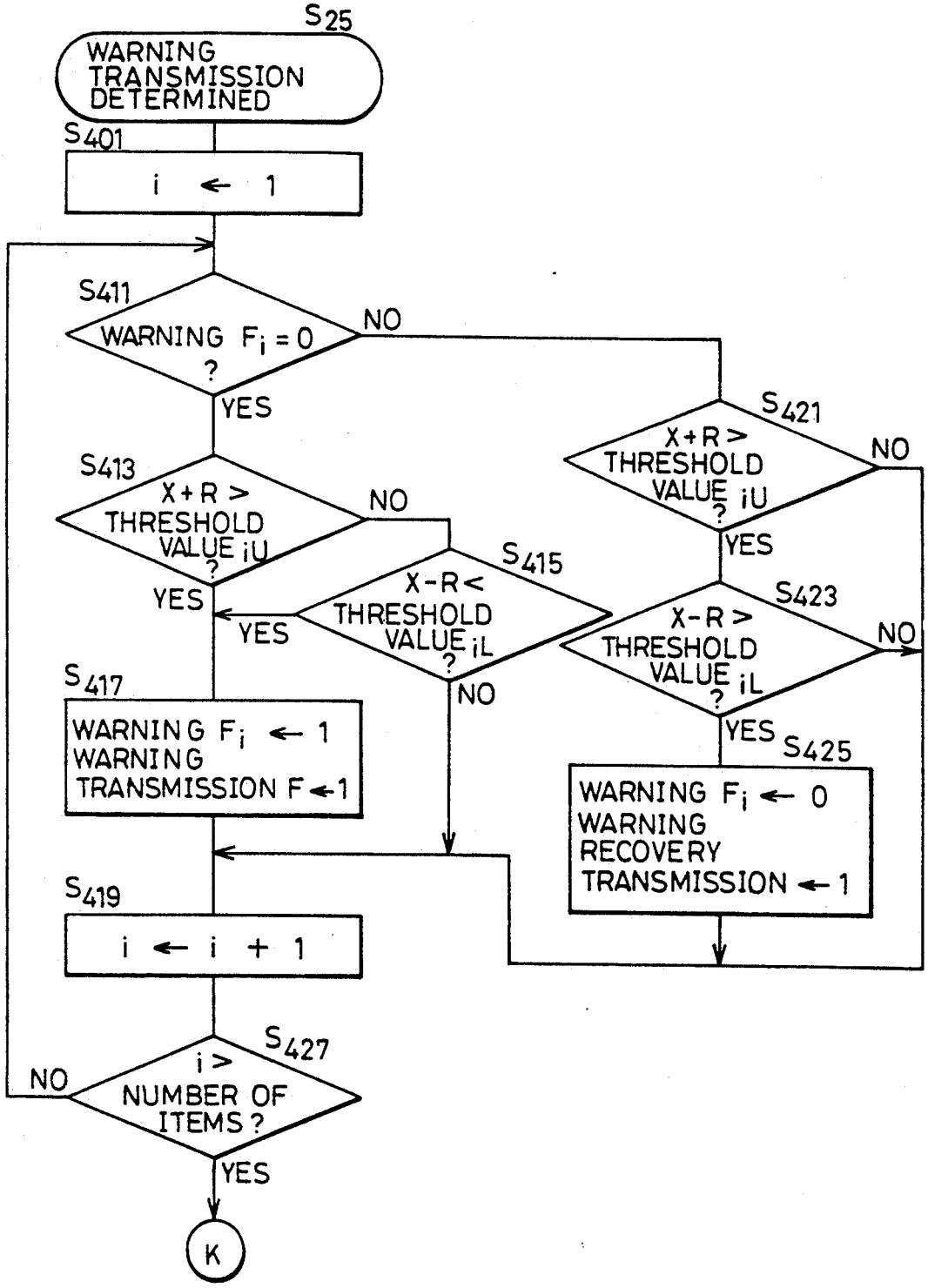
FIG. 15 is a flow chart showing a part of the specific content of a warning transmission determination processing in FIG. 9.
Figure 16:
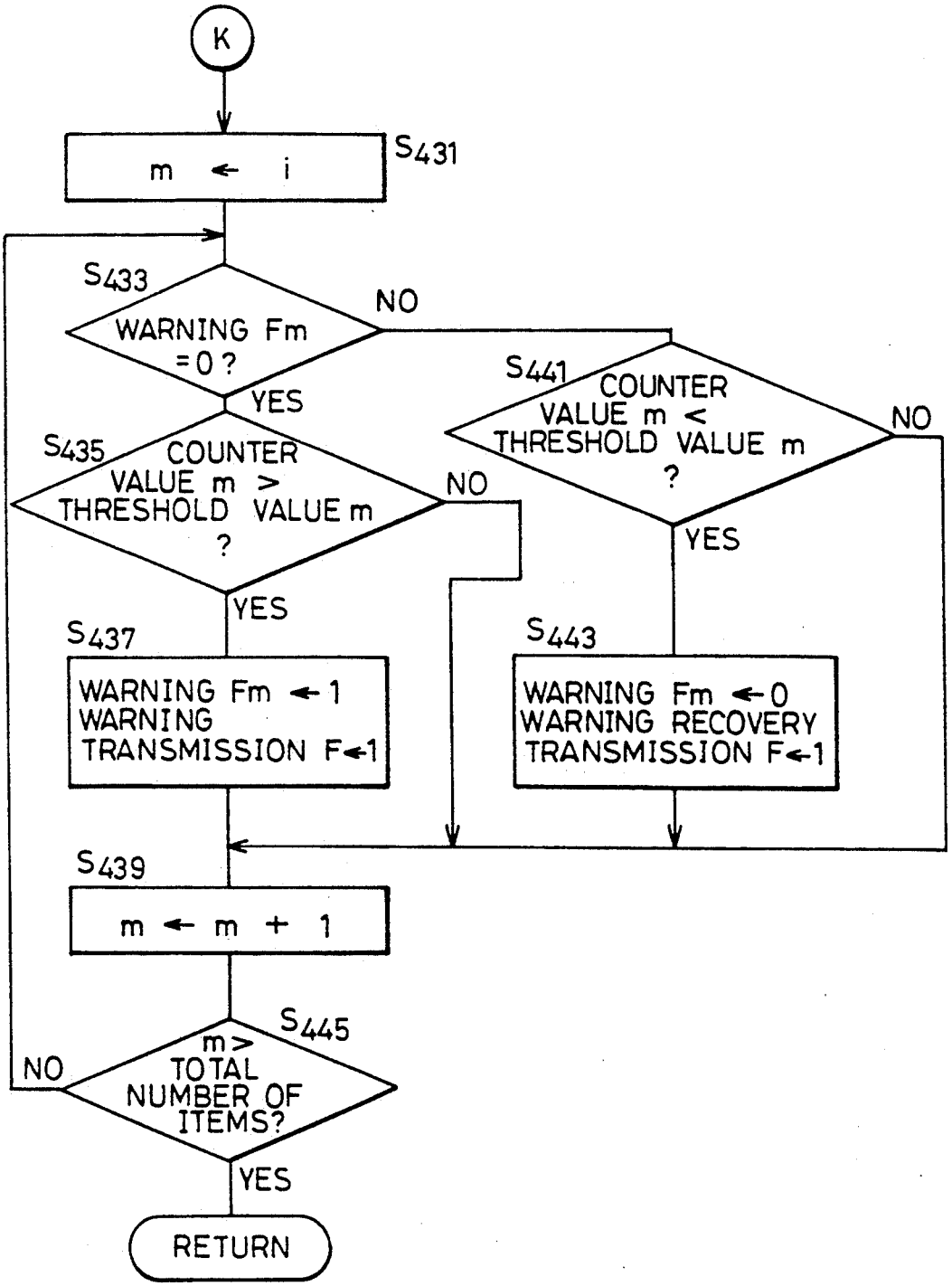
FIG. 16 is a flow chart showing the remaining part of the specific content of the warning transmission determination processing routine.

* Warning Transmission Determination (FIGS. 15, 16)

In this processing, warning transmission, etc. are controlled.

A processing of steps S401–S427 is for executing a warning transmission if any of the values of the element data is without its tolerance range and a warning recovery transmission when the value returns within the tolerance range.

An initialization value "1" is set in the item number i representing the kind of the element data (S401).

In step S411, a warning flag related to element data designated by the item number i (the element data of the first item for the first time) is determined. If the result of determination indicates that the warning flag related to the element data is "0" (S411; YES), then it is determined whether or not the value of the element data is within the tolerance range inherent to the element data, in other words whether or not within the range below the maximum threshold value$_{iU}$ and above the minimum threshold value $_{iL}$, and if the value is without the tolerance range (S413; YES or S415; YES), the warning flag $F_i$ and the warning transmission flag for the element data are both set to "1" (S417). Thus, the line connection processing (FIGS. 17–19) is executed, thereby transmitting the warning data to the center.

Meanwhile, in step S411, the warning flag of the element data designated by the item number i is "1" (S411; NO), it is determined whether or not the value of the element data is returned within the tolerance range, and if the value has returned to the range (S421; YES, and S423; YES), the warning flag $F_i$ for the element data is reset to "0", and the warning recovery transmission flag is set to "1" (S425). Thus, the line connection processing (FIGS. 17–19) is executed, thereby transmitting the warning recovery data to the center.

When the aforementioned processing is conducted to all the element data (S427; YES), processings after step S431 will be executed.

A processing of steps S431–S445 is for executing a warning transmission when the count values (=frequencies) of the JAM counter and PM counter are above the inherent threshold values and executing a warning recovery transmission when the value returns to the level below the threshold values, respectively.

An item number m representing the kinds of the JAM counter and the PM counter is set to an initialization value "i (the value of the final item number of the element data+1)" (S431).

In step S433, a warning flag for the JAM counter or the PM counter designated by the item number m is determined. If the result of the determination indicates that the warning flag for the JAM counter or the PM counter is "0" (S433; YES), it is determined whether or not the count value is within the tolerance range inherent to the counter, in other words whether it is above a threshold $value_m$ (see FIGS. 18 and 24), and if it is above the threshold value (S435; YES), a warning flag $f_m$ and a warning transmission flag for the counter are both set to "1" (S437). In response, the line connection processing (FIGS. 17-19) is executed, thus transmitting the warning data to the CPU 91 of the center.

In step S433, if the warning flag for the JAM counter or the PM counter designated by the item number m is "1" (S433; NO), it is determined whether or not the count value returns to the level below the threshold value, and if it has returned to the level (S411; YES) the warning flag $F_m$ for the counter is reset to "0", and the warning recovery transmission flag is set to "1". In response, the line connection processing (FIGS. 17-19) is executed, thus transmitting the warning recovery data to the CPU 91 of the center.

When the aforementioned processing has been conducted to all the count data (S445; YES), the process returns to the main routine. As stated above, the warning transmission and the warning recovery transmission are controlled.

Figure 17:
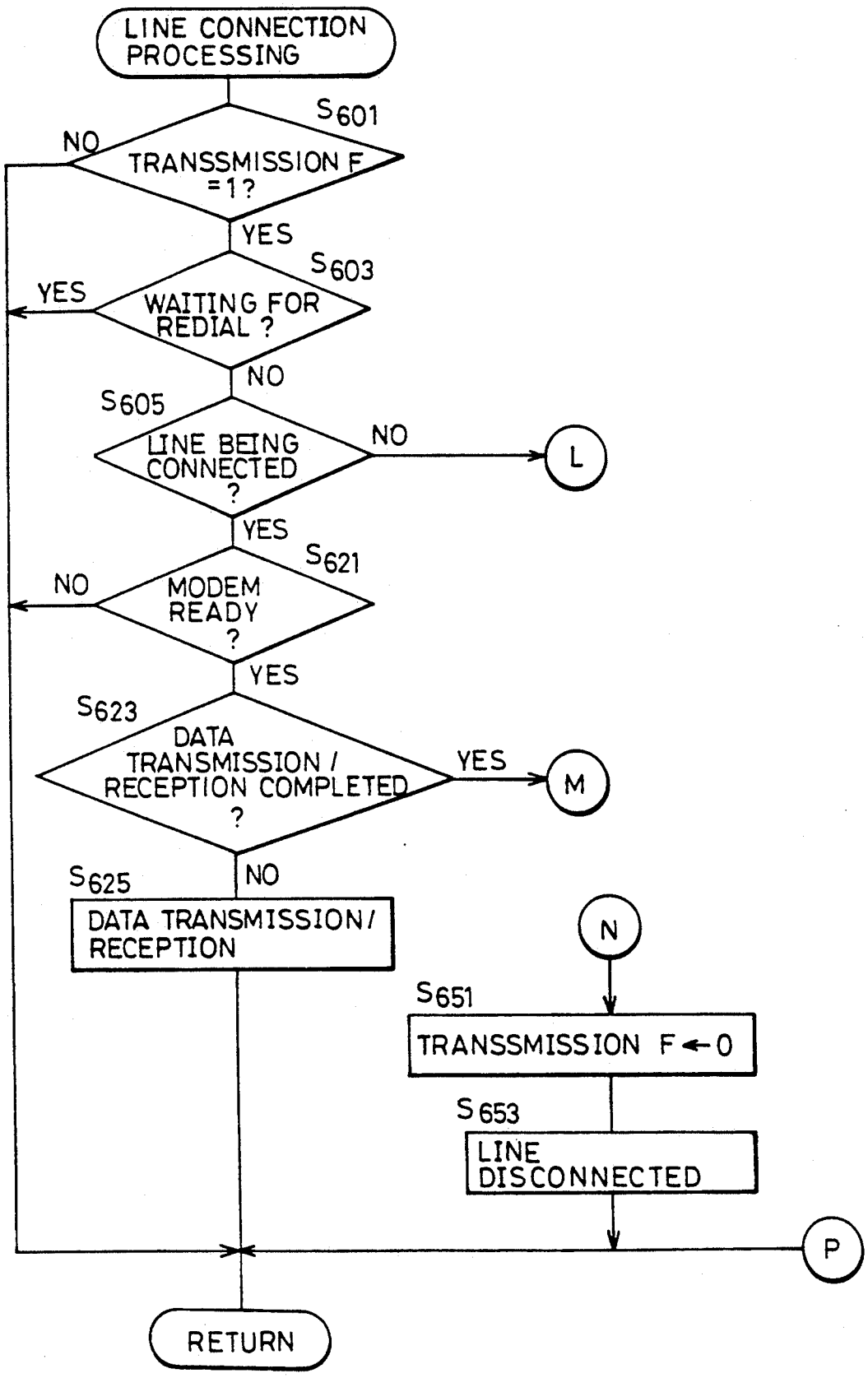
FIG. 17 is a flow chart showing a part of the specific content of a line connection processing routine in FIG. 9.
Figure 18:
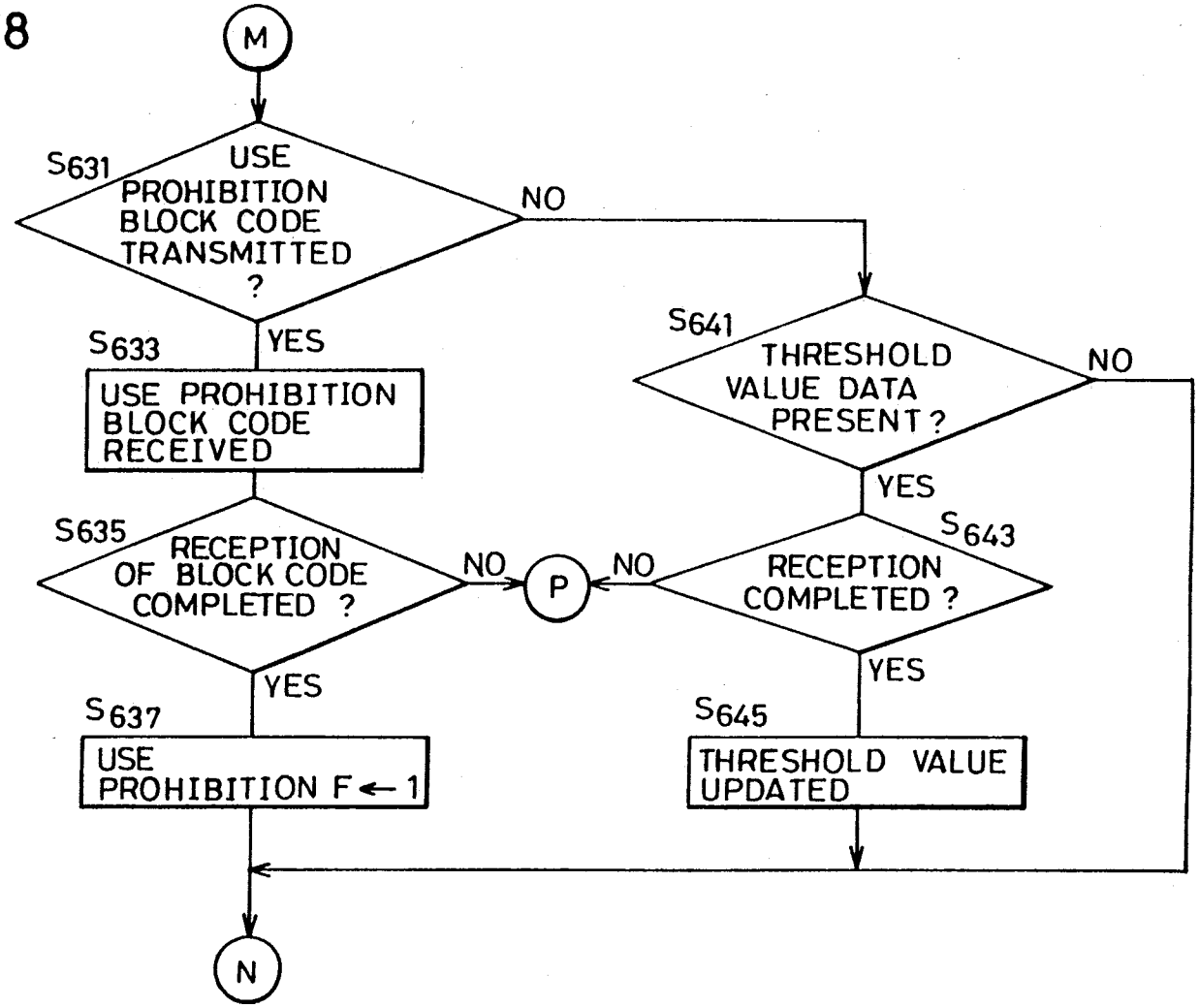
FIG. 18 is a flow chart showing a part of the specific content of the line connection processing routine in FIG. 9.
Figure 19:
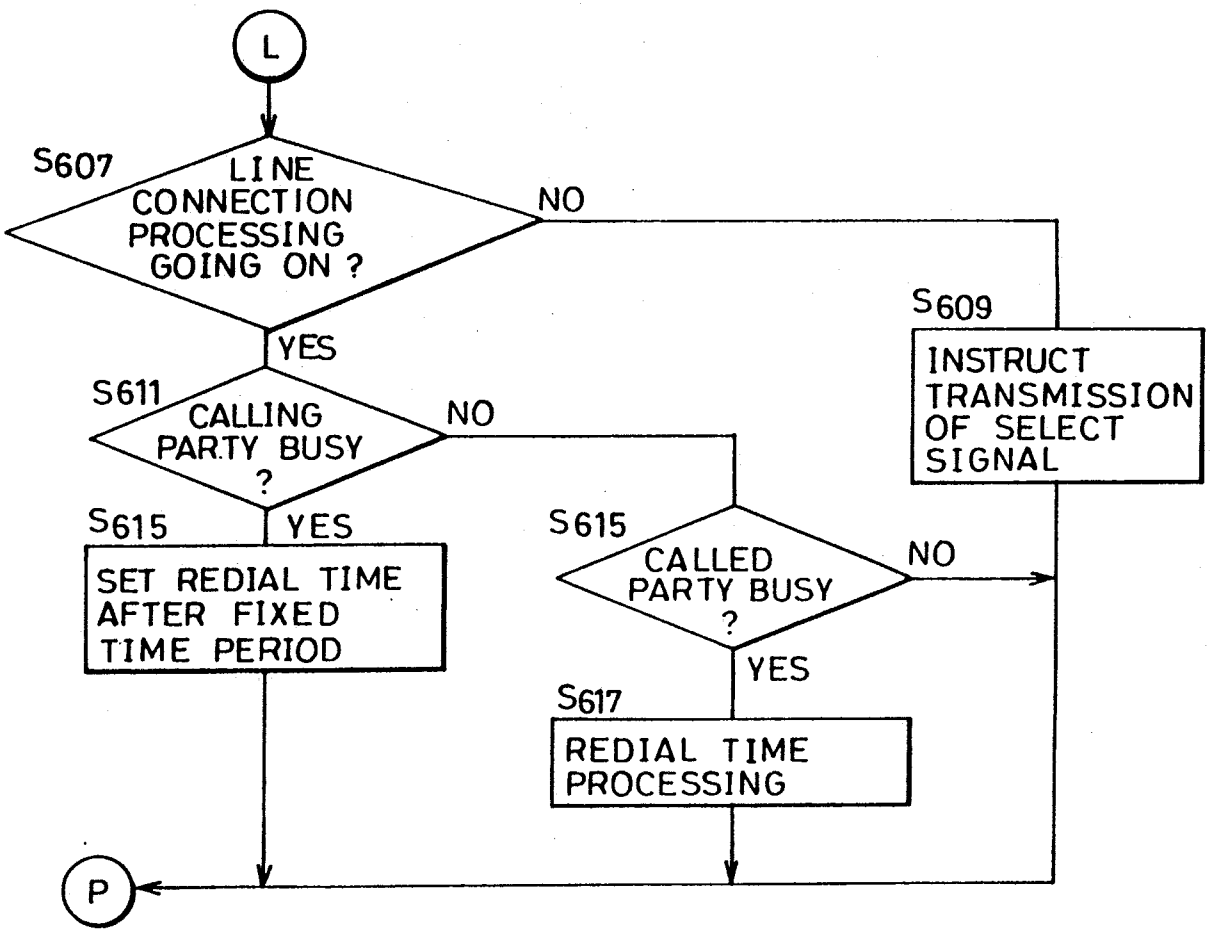
FIG. 19 is a flow chart showing the remaining part of the specific content of the line connection processing in FIG. 9.

* Line Connection Processing (FIGS. 17-19)

In this processing, the center is called in response to "one of the transmission flags=1", and after connection to the communication line, data corresponding to the above-stated transmission flag is transmitted. Furthermore, a data communication with the CPU 91 of the center is conducted.

When one of the transmission flags is set to "1" (S601; YES), an instruction of calling the modem 72 on the center side is given to the modem 52 (S609), provided that the modem 52 is not waiting for redial (S603; NO), the communication line is not connected to the modem 72 of the center side (S605; NO), and it is not in a waiting period after the instruction of calling the modem 72 on the center side.

As the result of the processing in step S609, if the telephone set 53 is "busy", and calling of the modem 72 at the center side cannot be executed (S611; YES), time after a prescribed time period is set as redial time (S613). Thus, until the redialed time, the determination in step S603 is maintained as "YES". More specifically, the processing in step S609 is not executed. At the redial time, an instruction of calling the modem 72 on the center side is once again given to the modem 52 (S609).

As the result of transmission of a select signal for the center from the modem to the communication network, in response to the processing in step S609, if the modem 72 on the center side is "busy" (including the case in which connection to the modem 72 is made but no response is given from the CPU 91) is determined (S615; YES), redial time is set as with the above-stated case (S617), and the processing in S609 is once again executed at the set redial time.

When the select signal for the center is transmitted from the modem 52 to the communication network in response to the processing in step S609, and the communication line is connected to the modem 72 on the center side (S605; YES), after a waiting period for the modem 52 being ready (S621; YES), data corresponding to the transmission flag set to "1" is transmitted to the center side (S625). In step S625, reception processing of incoming data transmitted from the center side is also conducted.

The data received in step S625 includes the next fixed transmission date and time, the present time, the due date, etc. if it is the case of a communication by the constant transmission, for example. In the case of the warning transmission, a use prohibition block code, count data threshold values, etc. can be received (see S917 in FIG. 23). When a communication error takes place, an instruction of re-transmitting data is received (see S907 in FIG. 23).

Thus, the data communication with the center side is completed (S623; YES), the process proceeds to processings after step S631.

In step S631, it is determined whether or not a use prohibition block code is present in the data received in step S625. As a result, if there exists a use prohibition block code, a reception processing for the use prohibition block code is conducted (S633). When the reception processing is completed (S635; YES), the use prohibition flag is set to "1" (S637). Thus, a use prohibition processing is executed. Thereafter, the transmission flag is reset to "0" (S651), and line disconnection with the communication line is executed (S653).

In step S631, if it is determined that the use prohibition block code is not present, and threshold value data is present in the data received in step S625 (S641; YES), the threshold value data is updated (see S645 in FIG. 23, S917) after the reception is completed (S643: YES) Then, the transmission flag is reset to "0" (S651), and a line disconnecting processing with the communication line is executed (S653).

If neither the use prohibition block code nor the threshold value data exists in the data received in step 625 (S641; NO), the transmission flag is immediately reset to "0" (S651), and a line disconnecting processing with communication line is executed (S653).

Figure 20:
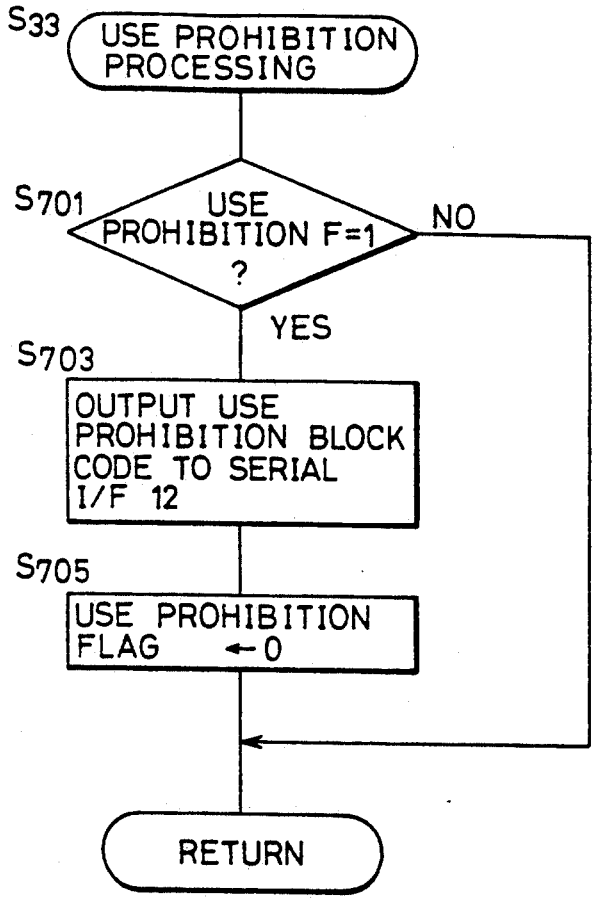
FIG. 20 is a flow chart showing the specific content of a use prohibition processing routine shown in FIG. 9.

* Use Prohibition Processing (FIG. 20)

As stated above, when the use prohibition flag is set to "1" in the course of the line connecting processing (see step S637 in FIG. 18), the use prohibition block code is transmitted to the CPU 41 of the copying machine (S703), and then the use prohibition flag is reset to "0" (S705).

Figure 8:
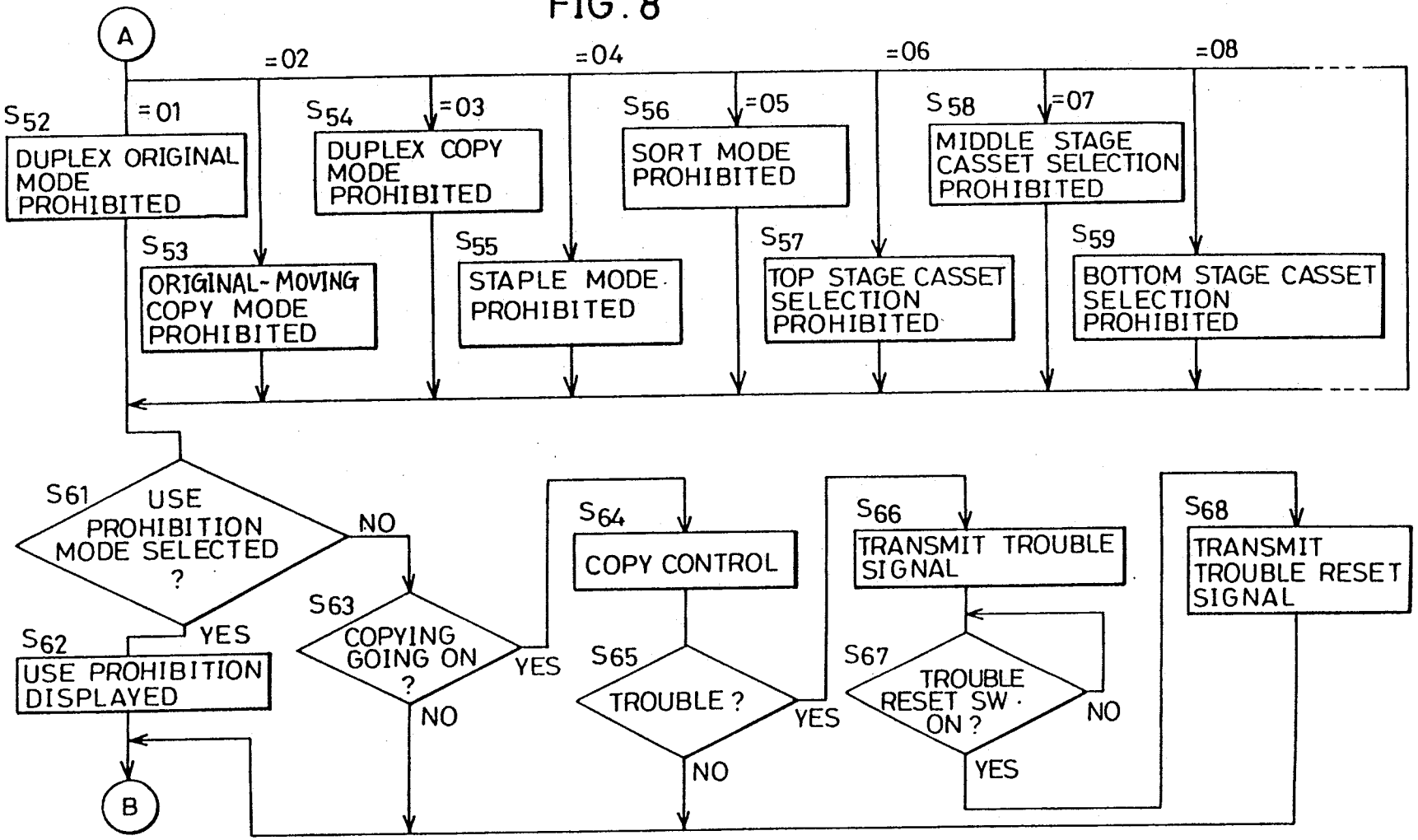
FIG. 8 is a flow chart showing the remaining part of the main routine of the processing of the CPU in the copying machine in the system shown in FIG. 1.

The CPU 41 in response prohibits a mode or an operation corresponding to the use prohibition block code (see FIG. 8, S52-S59).

Processing in Center

Figure 21:
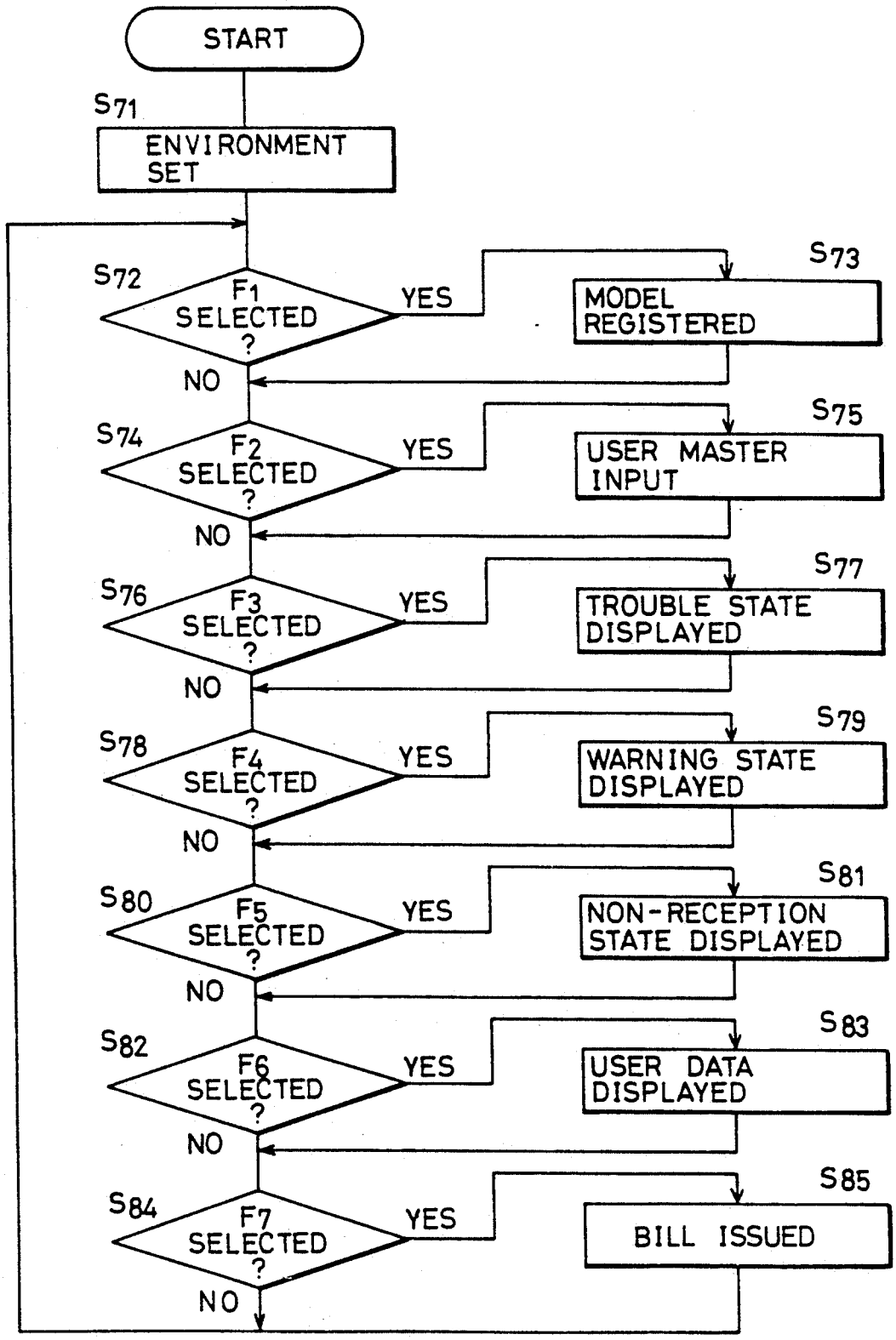
FIG. 21 is a flow chart showing a processing in a CPU in the center in the system shown in FIG. 1.

Now, the processing in the CPU 91 installed in the computer 90 of the center will be described in conjunction with FIGS. 21-24.

a) F1-F7 key processings (FIG. 21)

In the CPU 91, the processing is initiated by turning on a power supply, and environment for the modem, the printer, etc. are set (S71). Thereafter, the following modes are set or the following processings are executed in response to key input operations of F1-F7.

·F1 Key Operation (S72; YES)

Figure 27:
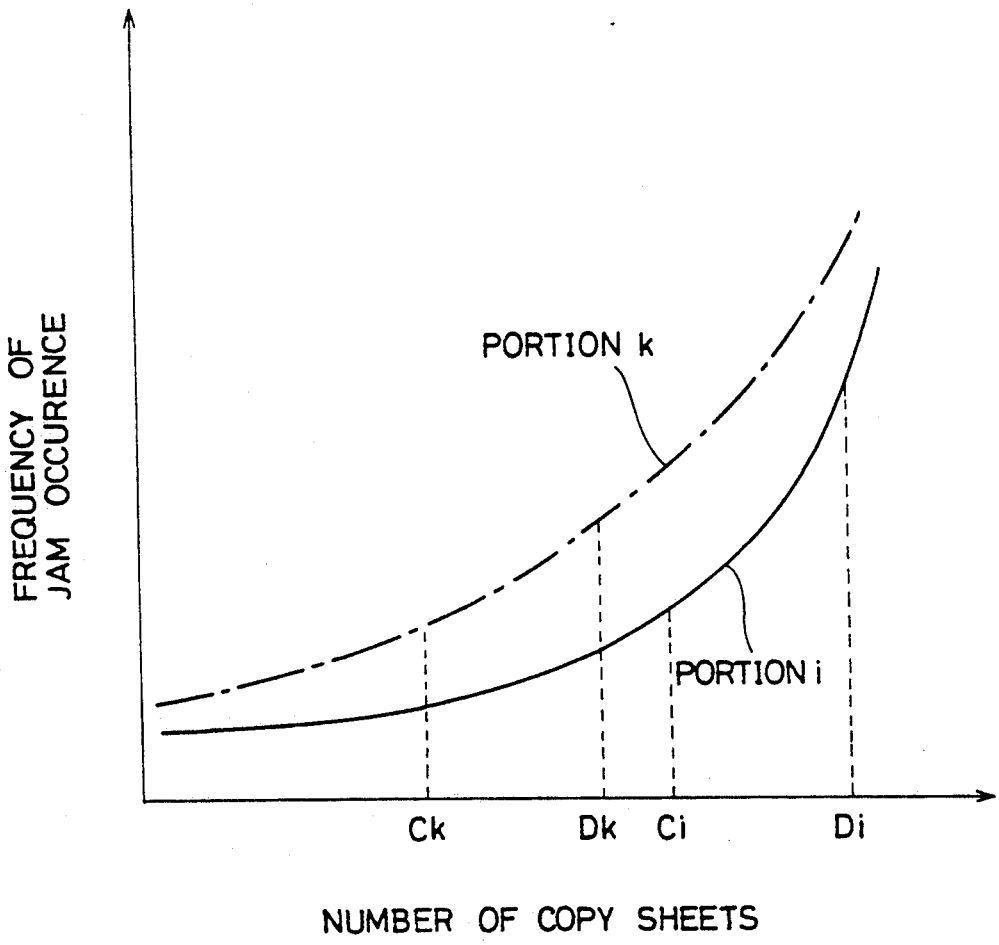
FIG. 27 is a representation showing the statistical relation between the number of copy sheets and the frequency of jam occurrence for two representative portions used in accordance with one embodiment of the invention.

An acceptance mode for model registration is set (S73). More specifically, registration of a model name, the number of items of element data, the name of each pieces of element data, the threshold value of each element data, and the threshold value of each count data is accepted. As for the threshold value of the count data, a standard threshold value (initialization threshold value) for the number of copy sheets Ci and a limit threshold value (update threshold value) for the number of copy sheets $D_i$ are sometimes set as illustrated in FIG. 27 depending upon the portions. Furthermore, if the count data is above the limit threshold value for the number of copy sheets Di, a prohibition flag Fi (see FIG. 24) is set for selectively instructing whether the use of only the portion involved is prohibited, the use of the entire copying machine is prohibited or the use is continued until a serviceman comes and checks what is going on.

FIG. 27 is a representation statistically showing the characteristics in the relation between the number of copy sheets and the frequency of jam occurrence, in which the chain dotted line represents portion k, and the solid line represents portion i.

In the portion k, for example, the frequency of jam occurrence increases as the number of copy sheets increases. Accordingly, if it is permitted to continuously use the machine until a serviceman responds, the situation will not worsen drastically. Therefore, in the portion k, the prohibition flag Fi is set to "3", and the continuous use of the machine is not prohibited (see FIG. 24). However, it must be confirmed that there is not any possibility that adverse effects are given to the other parts.

In the portion i, the frequency of jam occurrence drastically increases somewhere around the number of copy sheets of Di. Accordingly, the prohibition flag Fi is set to "1" or "2".

Figure 24:
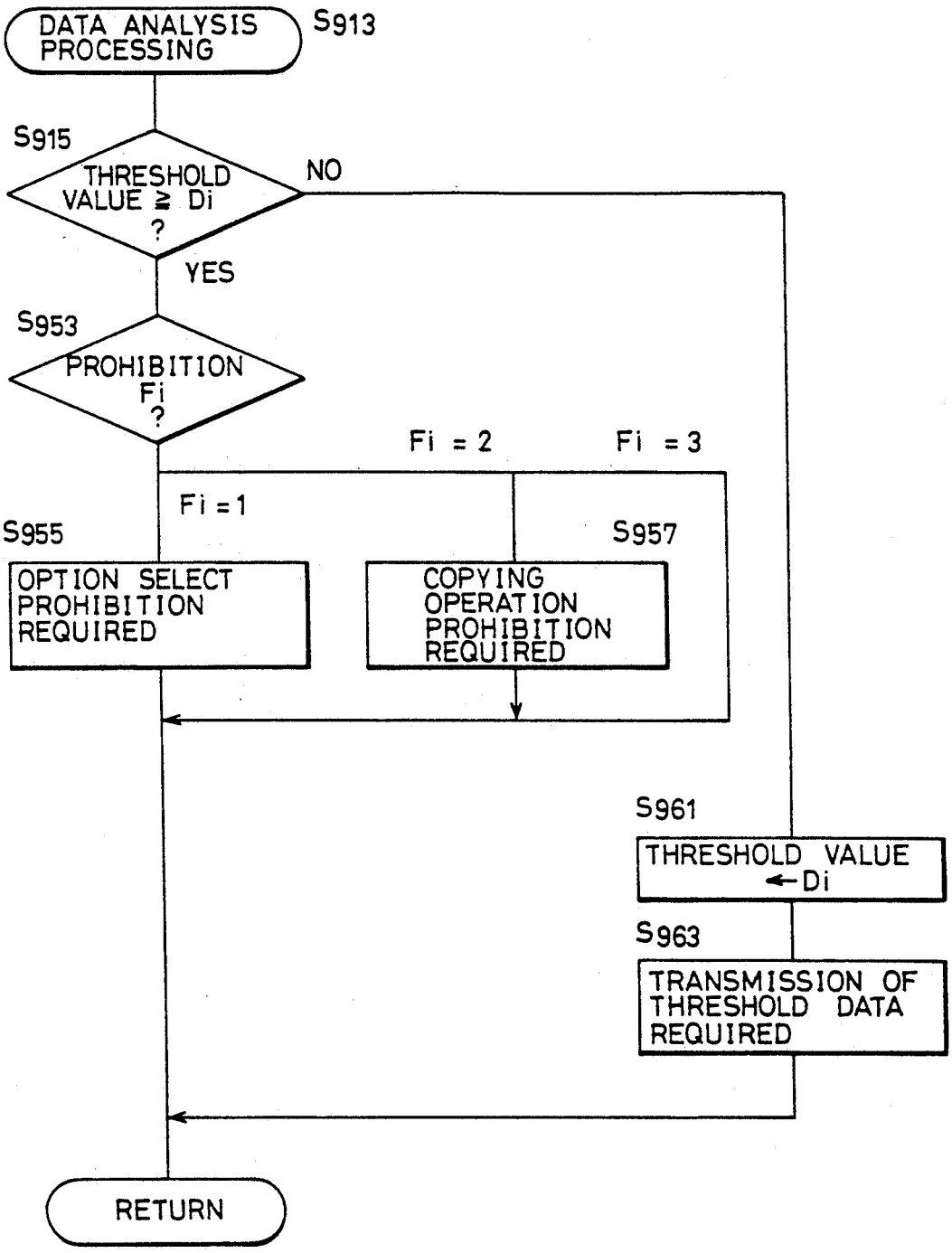
FIG. 24 is a flow chart showing the specific content of a data analysis processing routine shown in FIG. 23.

In the state of "prohibition flag Fi=1", the use of only the portion involved is prohibited (see FIG. 24·S955). This is because the portion is installed as an option and copying operation can be conducted even if the use of the portion is prohibited.

In the state of "prohibition flag Fi=2", the use of the entire copying machine is prohibited (see FIG. 24·S957). This is because the portion is inevitable for copying operation such as a fixing roller, and there could be serious damages if the jam is left as it is. The numbers of copy sheets Ci and Di, and the initial threshold values, update threshold values, and prohibition flags Fi corresponding these numbers are set for every portion or every operation mode as to each model and stored in an RAM 97.

·F2 Key Operation (S74; YES)

A registration acceptance mode for a user's master is set (S75). Registration of the name, address and telephone number of a user, the name of a model, the serial number, date and time for fixed transmission is accepted. A DTID is automatically set. If a use prohibition block code is input, the use prohibition flag is set to "1" (see FIG. 25). More specifically, by a user input, a portion to be prohibited from being used can be instructed.

·F3 Key Operation (S76; YES)

The situation of a trouble is displayed (S77). More specifically, user information (the name, address and telephone number of the user. and model name), and the date and time of occurrence of a copy machine which made a trouble transmission displayed on the display 92 together with the content of the trouble. The number of troubles which took place is always displayed at the corner of the display 92 irrespective of the F3 key operation.

·F4 Key Operation (S78; YES)

The situation of warning is displayed (S79). The user information, etc. of a copying machine which made a warning transmission is displayed on the display 92 together with the content of the warning. The number of warnings is always displayed at the corner of the display irrespective of the F4 key operation.

·F5 Key Operation (S80; YES)

The non-reception condition is displayed (S81)

More specifically, the user information of a copying machine which does not give a fixed transmission at prescribed fixed transmission time is displayed on the display 92. The number of non-receptions is always displayed at the corner of the display 92 irrespective of the F4 key operation.

·F6 Key Operation (S82; YES)

A user data display mode is set (S83) More specifically, upon selecting a user, the user information is displayed on the display 92. When a submenu is selected, count values in various counters of the user copying machine (total counter, separate paper side counter, JAM counter, trouble counter, PM counter), and element data are displayed for each item, or each month.

·F7 Key Operation (S84; YES)

A bill is printed out (S85) The printer 94 is activated, and a charge amount calculated based on the count value of the total counter and a prescribed calculation formula is printed out as a bill.

Figure 22:
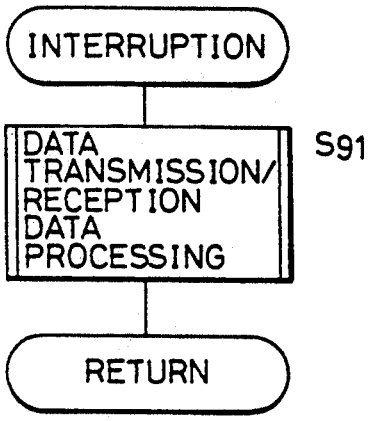
FIG. 22 is a flow chart showing an interruption processing in the CPU in the center in the system shown in FIG. 1.
Figure 23:
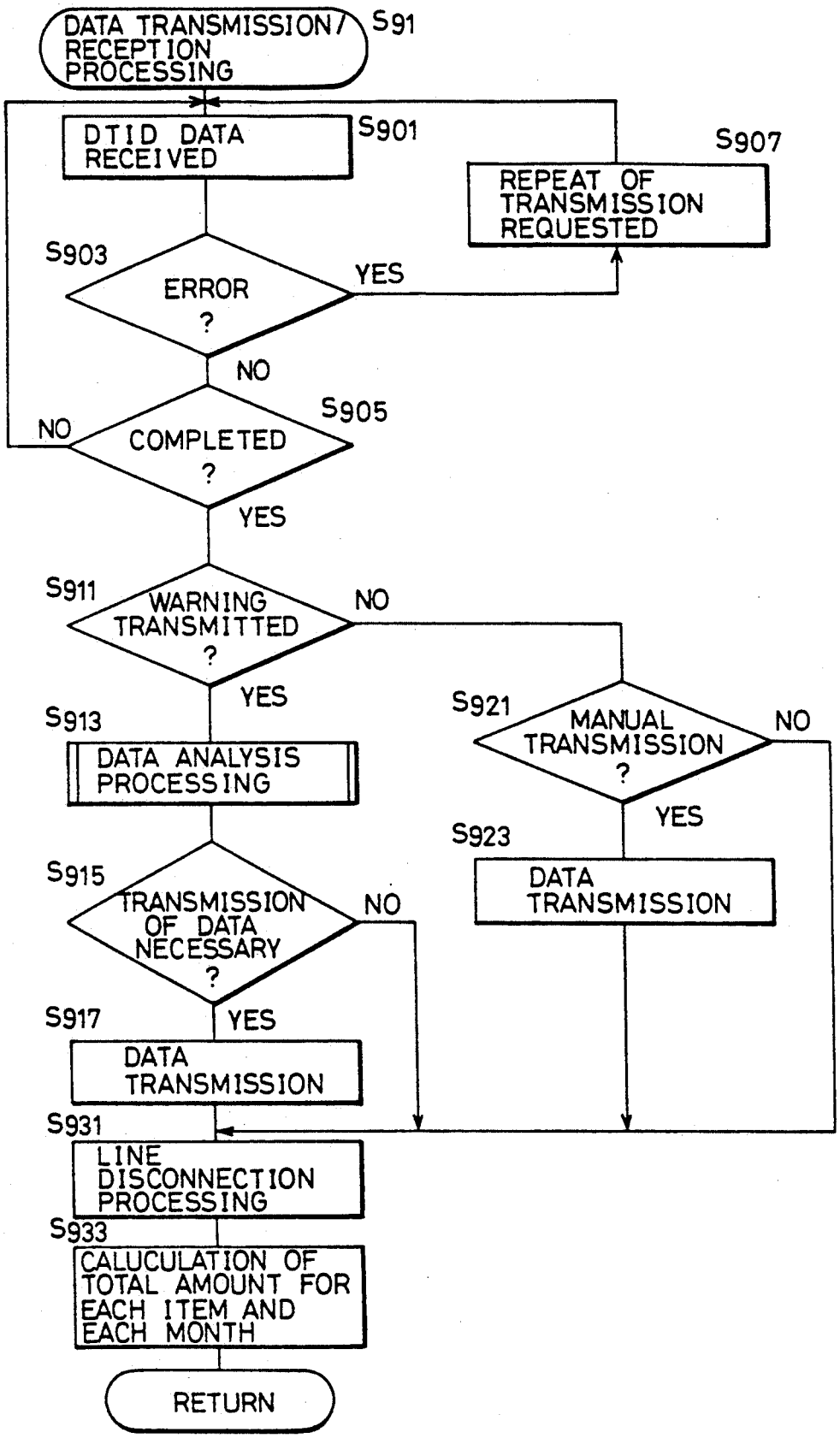
FIG. 23 is a flow chart showing a data transmission/-reception processing in the CPU in the center in the system shown in FIG. 1.

(b) Interruption Processing (FIGS. 22-24)

The CPU 91 receives data transmitted from the data terminal by means of interruption processing and subjects the received data to a prescribed processing (S91).

Upon an interruption from the data terminal, the DTID and data are received (S901) If a communication error takes place (S903; YES), the data terminal side is requested to retransmit the data (S907).

When the above-stated reception processing is completed (S905; YES), it is determined whether the communication was initiated by the warning transmission flag being set to 1, the manual transmission flag being set to 1, or another transmission flag is being set to 1 (S911, S921).

If the determination result indicates that it was initiated by the warning transmission flag being set to "1" (see FIG. 16·S437) (S911; YES), a data analysis processing shown in FIG. 24 is executed (S913). Furthermore, if the result of the data analysis processing (S913) indicates that a use prohibition block code or an update threshold value (a threshold value corresponding to the number of paper sheets Di) should be transmitted to the data terminal (S915; YES), the use prohibition block code or the update threshold value are transmitted to that data terminal side (S917).

In the data analysis processing (S913·FIG. 24), it is determined whether or not the threshold value of count data corresponding to the warning transmission flag is an initial threshold value (a threshold value corresponding to the number of copy sheets Ci) or an update threshold value (a threshold value corresponding to the number of copy sheets Di) (S951).

If the determination result indicates that the threshold value of the count data is the initial threshold value (S951; NO), and a drastic increase in the jam frequency is not expected, in other words, there will not be any serious problem if the copying machine is used as it is, the update threshold value (threshold value corresponding to the number of copy sheets Di) is substituted as a new threshold value (S961). The update threshold value data is set to be transmitted to the data terminal (S963).

When the count data threshold value is not the initial threshold value (S951; YES), a determination is made on the prohibition flag Fi (S953). If the determination result indicates "Fi=1", since the portion or mode involved is not inevitable for copying operation such as a portion installed by an option, selection of the portion or setting of that mode is prohibited (S955). More specifically, use prohibition block codes other than "99" are set (see FIG. 26).

If "Fi=2", the portion or mode involved is a portion inevitable for copying operation such as a fixing roller, a serious damage would be caused if the jam is left as it is, and, therefore, the use of the entire copying machine is prohibited (S957). More specifically, the use prohibition block code 99 is set (see FIG. 26).

If "fi=3" the frequency of jam occurrence gradually increases as the number of copy sheets in the portion or mode involved increases, and the use is not prohibited because there will not be any serious problem if it is left as it is until a serviceman comes and checks it.

If a communication is initiated by the manual transmission flag being set to "1" (S921; YES), it is assumed that maintenance work such as parts exchange, is conducted ba serviceman. Therefore, the threshold value is reset to the initial threshold value (threshold value corresponding to the number of copy sheets Ci) for transmission (S923).

Then, after a line disconnecting processing of the communication line (S913), a total amount is calculated for each items/month. Furthermore, data for picture display is produced by an operator's selection (see FIG. 21).

According to the invention, the use of an arbitrary mode or an arbitrary portion in each of copying machines can be prohibited at the control center in which data for controlling the copying machines are stored. Accordingly, the use modes or options of the copying machine involved are limited (i.e. copying in a duplex mode is not available, a sorter is not available, etc.), but the use of certain limited modes can be secured without causing any serious damages.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of controlling a plurality of copying machines through a communication network, comprising the steps of:

receiving data from one of said copying machines;

detecting the state of trouble occurrence as to the particular portion of the copying machine based on said received data;

determining whether or not the use of said particular portion should be prohibited based on said detected state of trouble occurrence; and transmitting to the copying machine a prohibition signal instructing prohibition of the use of said particular portion, when it is determined that the use of said particular portion should be prohibited.

2. A method of controlling a plurality of copying machines through a communication network, comprising steps of:

receiving data from one of said copying machines;

detecting the state of trouble occurrence in a particular operation mode of the copying machine based on said received data;

determining whether or not execution of said particular operation mode should be prohibited, based on said detected state of trouble occurrence; and transmitting to the copying machine a prohibit signal instructing prohibition of the execution of said particular operation mode, when it is determined that the execution of said particular operation mode should be prohibited.

3. A copying machine control system including a data terminal connected to a copying machine and a centralized control unit communicating with the data terminal through a communication network, wherein said data terminal includes;

first reception means for receiving data from said copying machine, calculation means for calculating the frequency of trouble occurrence as to a particular portion or operation mode of said copying machine based on said received data, first transmission means for transmitting data to said centralized control unit when said calculated frequency of trouble occurrence is more than a prescribed threshold value, and said centralized control unit includes;

second reception means for receiving data from said data terminal, determination means for determining whether or not the use of a particular portion or operation mode of said copying machine should be prohibited based on the data from said data terminal, and second transmission means for transmitting to said data terminal a prohibition signal instructing prohibition of the use of said particular portion or operation mode, when said determination means determines that the use of said particular portion or operation mode should be prohibited.

4. A control system as recited in claim 3, wherein said determination means determines whether or not the operation of the entire copying machine should be prohibited based on the data from said data terminal, and said second transmission means transmits to said data terminal another prohibition signal instructing prohibition of the operation of the entire copying machine, when said determination means determines that the operation of the entire copying machine should be prohibited.

5. A control system as recited in claim 3, wherein said prescribed threshold value is variable.

6. A control system as recited in claim 5, wherein said centralized control unit includes third transmission means for transmitting data for using as a threshold value to said data terminal, and said prescribed value is changed based on the data transmitted from said centralized control unit.

7. A centralized control unit controlling a plurality of copying machines through a communication network, comprising:

reception means for receiving data from each of the copying machines;

storage means for storing data indicaticating the state in which a particular portion or operation mode of each of the copying machines should be prohibited;

determination means for determining whether or not the use of said particular portion or operation mode should be prohibited based on data from each of the copying machines and by referring to said storage means, transmission means for transmitting to the copying one of said copying machines a prohibition signal instructing prohibition of the use of said particular portion or operation mode, when said determination means determines that the use of said particular portion or operation mode of machine should be prohibited.

8. A control system as recited in claim 7, further comprising input means for inputting data instructing prohibition of the use of an arbitrary portion or operation mode of one of the copying machines, wherein said transmission means transmits to the copying machine a prohibition signal instructing prohibition of the use of said arbitrary portion or operation mode based on the data input from said input means.

* * * * *